United States Patent [19]

Whitestone

[11] 3,998,054

[45] Dec. 21, 1976

[54] ROTARY MECHANISM WITH IMPROVED VOLUME DISPLACEMENT CHARACTERISTICS

[76] Inventor: Bruce G. Whitestone, 1229 Mesquite Trail, Benbrook, Tex. 76126

[22] Filed: Apr. 16, 1975

[21] Appl. No.: 568,433

[52] U.S. Cl. ..... 60/517; 418/61 B

[51] Int. Cl.[2] ..... F01C 1/02; F03C 3/00

[58] Field of Search ..... 60/517–526; 418/61 B

[56] References Cited

UNITED STATES PATENTS

| | | | |
|---|---|---|---|
| 658,556 | 9/1900 | Pitt | 418/61 B |
| 3,364,907 | 1/1968 | Jeanson | 418/61 B |
| 3,426,525 | 2/1969 | Rubin | 60/519 |
| 3,450,107 | 6/1969 | Radziwill et al. | 418/61 B |
| 3,483,694 | 12/1969 | Huber et al. | 60/519 |
| 3,509,718 | 5/1970 | Fezer | 60/519 |
| 3,762,167 | 10/1973 | Wahnschatte | 60/519 |

*Primary Examiner*—Allen M. Otrager
*Attorney, Agent, or Firm*—John F. Sieberth

[57] ABSTRACT

Rotary mechanisms having variable volume chambers useful for pumps, fluid motors, heat engines or the like and Stirling cycle heat engines embodying such rotary mechanisms are described. The improved volume displacement characteristics of these mechanisms result from having certain portions (apex portions) of the inner body (rotor) in continuous sealing engagement with the wall of the cavity with which it relatively rotates trochoidally, from having certain other portions (median portions) of the inner body in periodical sealing relationship with said wall during such rotation, and from having still other portions (connecting portions) always disengaged from said wall during the rotation. The Stirling cycle heat engines described have volumetric characteristics closely akin to those of an idealized engine.

43 Claims, 35 Drawing Figures

ROTARY MECHANISM WITH IMPROVED VOLUME DISPLACEMENT CHARACTERISTICS

This invention relates to a rotary mechanism of the type including relatively rotatable inner and outer bodies which have cooperating surfaces that during relative movement define variable volume chambers. More particularly this invention relates to rotary mechanisms of novel configuration and design rendering them suitable for application as pumps, fluid motors, heat engines or the like. By virtue of their characteristics, the rotary mechanisms of this invention are eminently suited for use in Stirling cycle engines (also known to those skilled in the art as external combustion engines).

Over the years considerable innovative effort has been devoted to the creation, design and development of rotary mechanisms of various configurations. In this connection reference may be made to the comprehensive classification of various prior art rotary piston machines as set forth by Felix Wankel in "Rotary Piston Machines" published by Iliffe Books Ltd., London, 1965. Some of these efforts have achieved considerable success, as witness the present-day commercial use in certain fields of application of the well known Wankel engine. Some of the efforts in the field have also been devoted to utilizing rotary mechanisms of the trochoidal type in the design of Stirling engines. Note for example the publication entitled "Stirling-Cycle Machines" by Graham Walker published by Oxford University Press, London, 1973, and references cited therein. Also see U.S. Pat. No. 3,800,526 to Wahnschaffe et al.

Despite the vastness and intensity of the prior efforts in the field, a common shortcoming of previously-proposed systems has been the lack of a rotary mechanism having a configuration capable of closely approximating a constant volume process. This invention is believed to represent a significant contribution inasmuch as it fills this pre-existing void in the art. In short, the rotary mechanism of this invention possesses volumetric characteristics closely akin to those of an idealized engine.

Basically, the rotary mechanism of this invention comprises an outer body (sometimes referred to as a stator) having a cavity and an inner body (sometimes referred to as a rotor) received within said outer body cavity for relative rotation therein with the axis of the inner body being laterally spaced from but parallel to the axis of the outer body cavity. The inner body has an outer surface basically composed of (i) a plurality of apex portions equally spaced about and equidistant from the axis of the inner body, (ii) a plurality of median portions equally spaced about and equidistant from the axis of the inner body, each median portion being positioned between and spaced apart from two said apex portions, and (iii) a plurality of connecting portions, each said median portion being joined to each of its adjacent apex portions by a connecting portion. Each apex portion is in continuous sealing engagement with the inner surface of the peripheral wall of said outer body cavity during relative rotation of said bodies about said axes. Each said median portion periodically is in sealing engagement with and periodically is disengaged from the inner surface of the peripheral wall of said outer body cavity during relative rotation of said bodies about said axes. In other words, during such relative rotation this particular sealing engagement successively involves each one of the median portions and occurs in a repetitive cyclical fashion so that at all times from one to two of the median portions is temporarily in sealing engagement with the inner surface of said peripheral wall. There is no sealing engagement between said connecting portions and the inner surface of the peripheral wall of said outer body cavity at any time during relative rotation of said bodies about said axes. The general shape or configuration of a mechanism satisfying the foregoing requirements is susceptible to considerable variation. For example, the inner body may possess any suitable number of apex portions so long as there are at least two of them. Mechanisms having from three to six apex portions are generally preferred, although systems with two or more than six apex portions may be found entirely suitable for particular applications. It will be noted that the outer body cavity takes on generally a multiple-sided profile having one more side than the number of apex portions on the inner body. Although not essential, it is preferable that the apex portions each have essentially the same contour, that the median portions each have essentially the same contour and that each such median portion be positioned equidistantly between two such apex portions.

Although a variety of mechanical arrangements are possible, another preferred embodiment of this invention involves a rotary mechanism as described in the preceding paragraph in which the inner and outer bodies are adapted to undergo relative rotation with internal gearing constraints. As will be more fully apparent from the ensuing description such an arrangement has the advantage of controlling or regulating the forces between the zones or areas of contact between the inner surface of the peripheral wall of the outer body and the apex and median portions of the inner body as these bodies undergo relative rotation. In this way excessive wear of the contacting surfaces of these bodies can be effectively minimized.

It will be understood and appreciated that the relative rotation between the inner and outer bodies may involve either body being maintained static or stationary with respect to the other body which rotates, or may involve both bodies undergoing rotational movement, either in the same direction of travel at different angular velocities or in opposite directions at any suitable angular velocities, whether different or identical. In most cases, however, it is preferable to utilize systems of this invention wherein the outer body is static with respect to the inner body, and the inner body is adapted to undergo the rotary motion.

In other preferred embodiments of this invention, contoured sealing plates are utilized in connection with the apex portions, or in connection with the median portions, and most preferably in connection with both the apex portions and the median portions of the inner body. Thus, for example, this invention provides the following preferred embodiments: (A) a rotary mechanism as described herein in which each apex portion is composed of a contoured sealing plate having progressive portions of its outer face in sealing engagement with the inner surface of the peripheral wall of said outer body cavity during relative rotation of said bodies about said axes, and (B) a rotary mechanism as described herein in which each median portion is composed of a contoured sealing plate periodically having progressive portions of its outer face in sealing engagement with the inner surface of the peripheral wall of said outer body cavity during relative rotation of said bodies about said axes. A system possessing the combination of (A) and (B) is particularly preferred.

As will become readily apparent as the description proceeds, another advantageous characteristic of the volume displacement rotary mechanisms of this invention is their amenability to porting or venting in highly desirable, yet basically simple mechanical arrangements. To illustrate, in accordance with one preferred embodiment of this invention, a rotary mechanism as above described is provided wherein each axial end of the cavity of the outer body is covered by a plate having therein a plurality of port openings radially spaced about the axis of said cavity and wherein said inner body has at its axial ends a plurality of channels each of which is positioned so that periodically upon relative rotation of said bodies about their respective axes open communication is provided between (i) a chamber defined by the outer surface of said inner body and the inner surface of the peripheral wall of said outer body cavity, and (ii) one of said port openings (iii) by way of one of said channels. In such a system it is particularly preferred that the number of port openings in each said plate be one greater than the number of apex portions of the inner body and that the number of channels at each axial end of the inner body be equal to the number of apex portions of the inner body, although other arrangements are possible and feasible.

Other particularly preferred embodiments of this invention are exemplified by a rotary mechanism as described in the preceding paragraph in which (i) the inner body has three apex portions and takes on a generally three-sided profile, (ii) the outer body cavity takes on a generally four-sided profile, (iii) each said plate has four port openings therein essentially equally spaced about and essentially equidistant from the axis of said cavity, and (iv) each axial end of said inner body has three said channels each one of which extends inwardly from one of the respective sides of the inner body. In such a rotary mechanism it is further preferred that the inner body have six separate channels and six connecting portions, three of said channels being located at each axial end of said inner body, each one of the respective six connecting portions having one said channel extending therefrom. And in this particular arrangement, it is even more preferable that the mouth of each successive channel around the periphery of the inner body be alternately positioned so that the first, third and fifth channels are at one axial end of said inner body and the second, fourth and sixth channels are at the other axial end of said inner body.

In accordance with still further preferred embodiments of this invention the distance of the lateral spacing between the axis of the inner body and the axis of the outer body cavity is substantially equivalent to the expression $$(1)/n\ (D - R)$$

wherein $n$ is the number of apex portions on said inner body, $D$ is the distance between the radially outermost point on the inner body and the axis of said inner body, and $R$ is the average radius of curvature of the profiles of said apex portions. While other configurations are possible and feasible, generally speaking rotary mechanisms satisfying these requirements possess excellent displacement characteristics and are simple to design and construct.

Rotary mechanisms as herein described wherein the length of the profile of each said apex portion is equivalent to from about 0.25 to about 2.75 radians constitute other preferred embodiments of this invention.

Additional preferred embodiments of this invention involve the utilization of the rotary mechanisms of this invention as a means of volume displacement in a Stirling cycle heat engine. As is well known in the art, the Stirling cycle engine comprises (i) a mechanism for varying in a cyclical manner the volumes of a plurality of chambers associated therewith, (ii) heat rejection means, (iii) regenerator means, and (iv) heat addition means. Thus, in accordance with this invention an improved Stirling cycle heat engine is provided by employing as the mechanism for varying the volumes of said chambers, a rotary mechanism as herein described.

The above and other embodiments, features, advantages, characteristics, and manifestations of the present invention will become still further apparent from a consideration of the ensuing description, appended claims and accompanying Drawings in which:

Figures 10A, 10B, 10C:
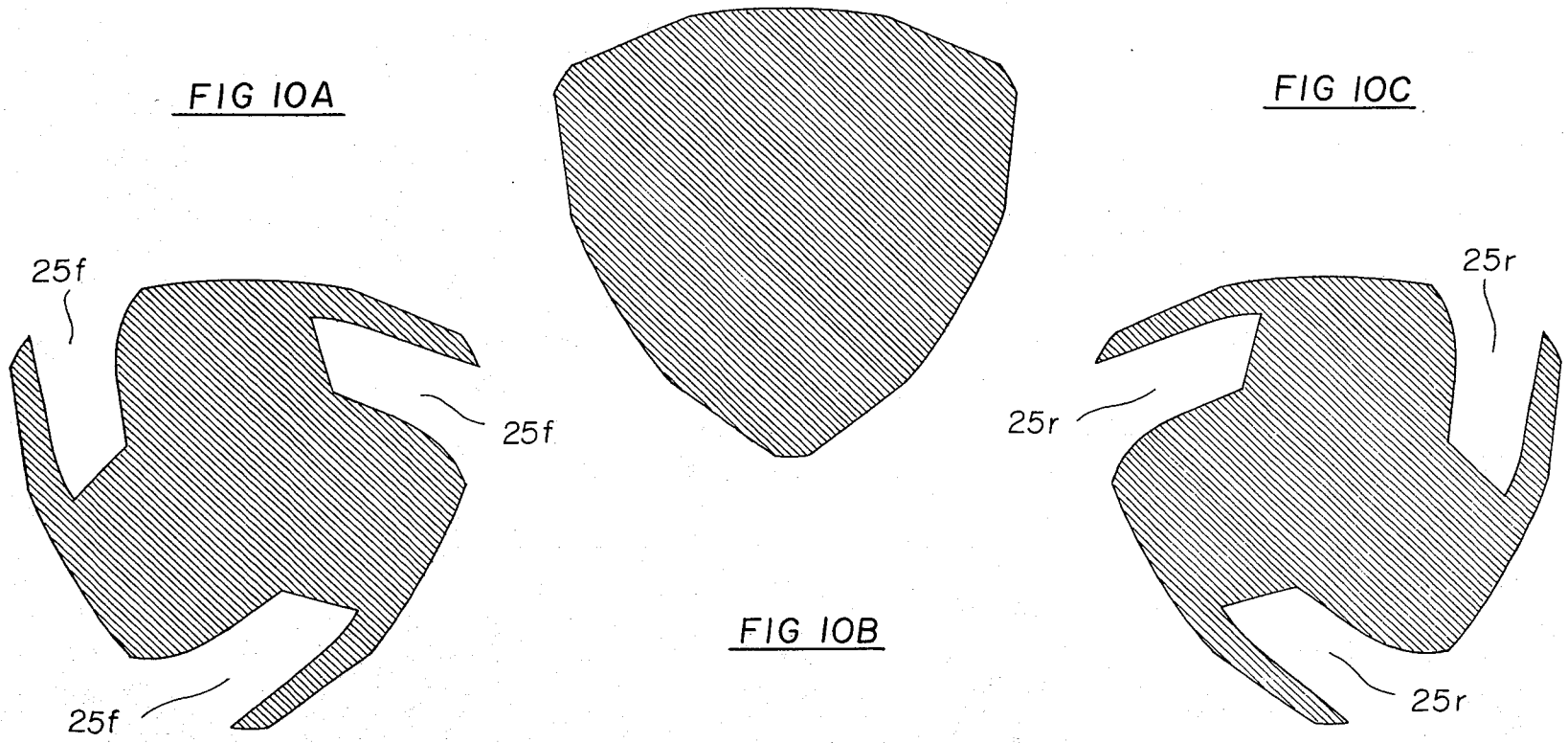
Figure 11:
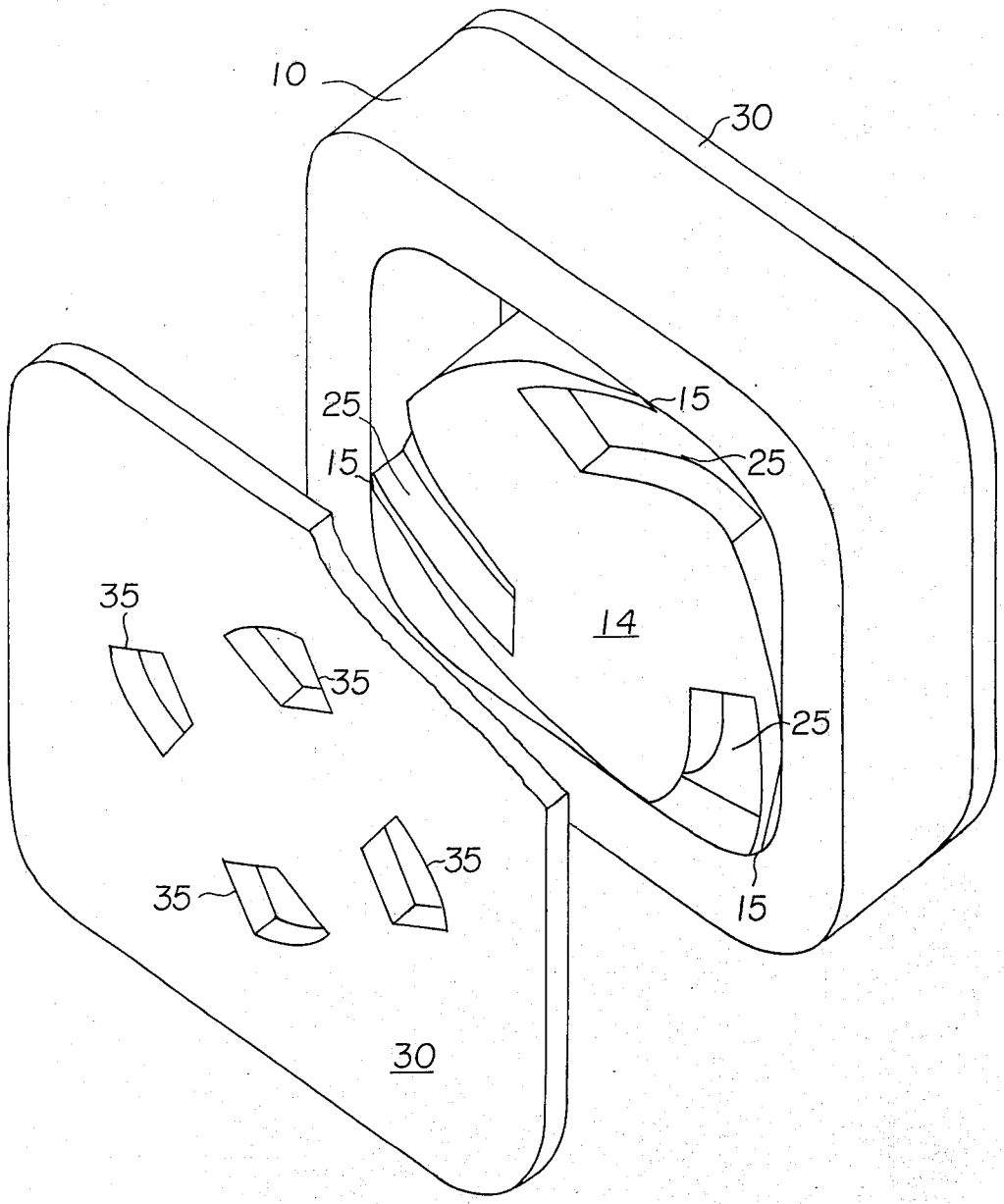
Figure 12:
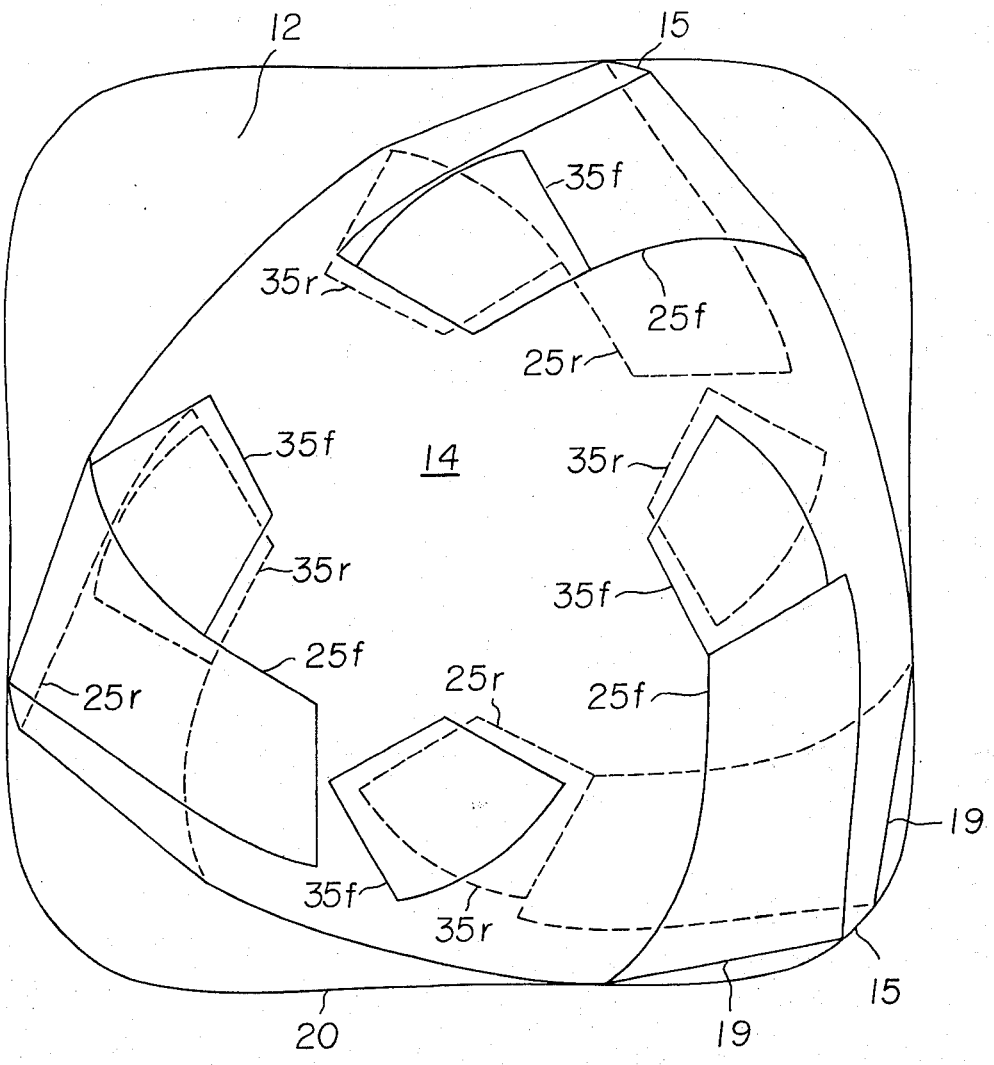
Figure 13:
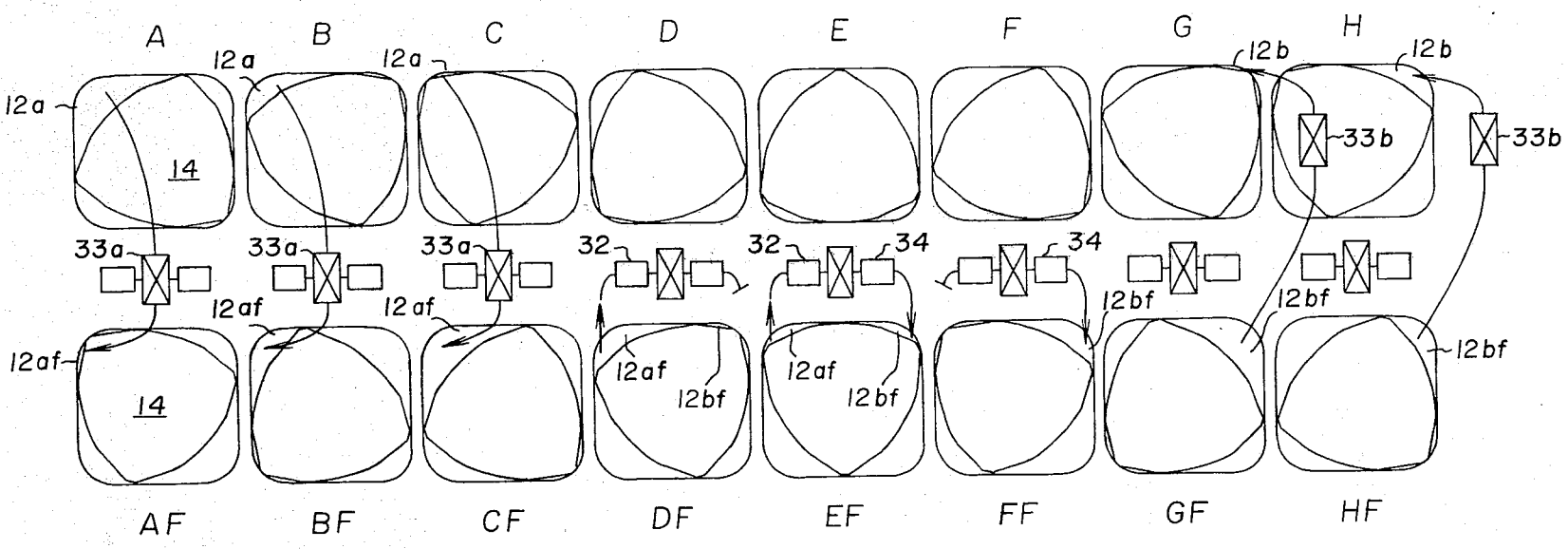
Figure 14:
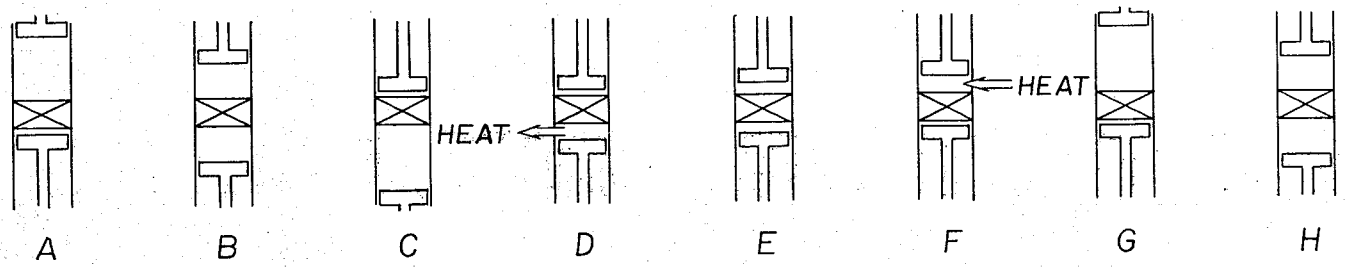
Figure 15:
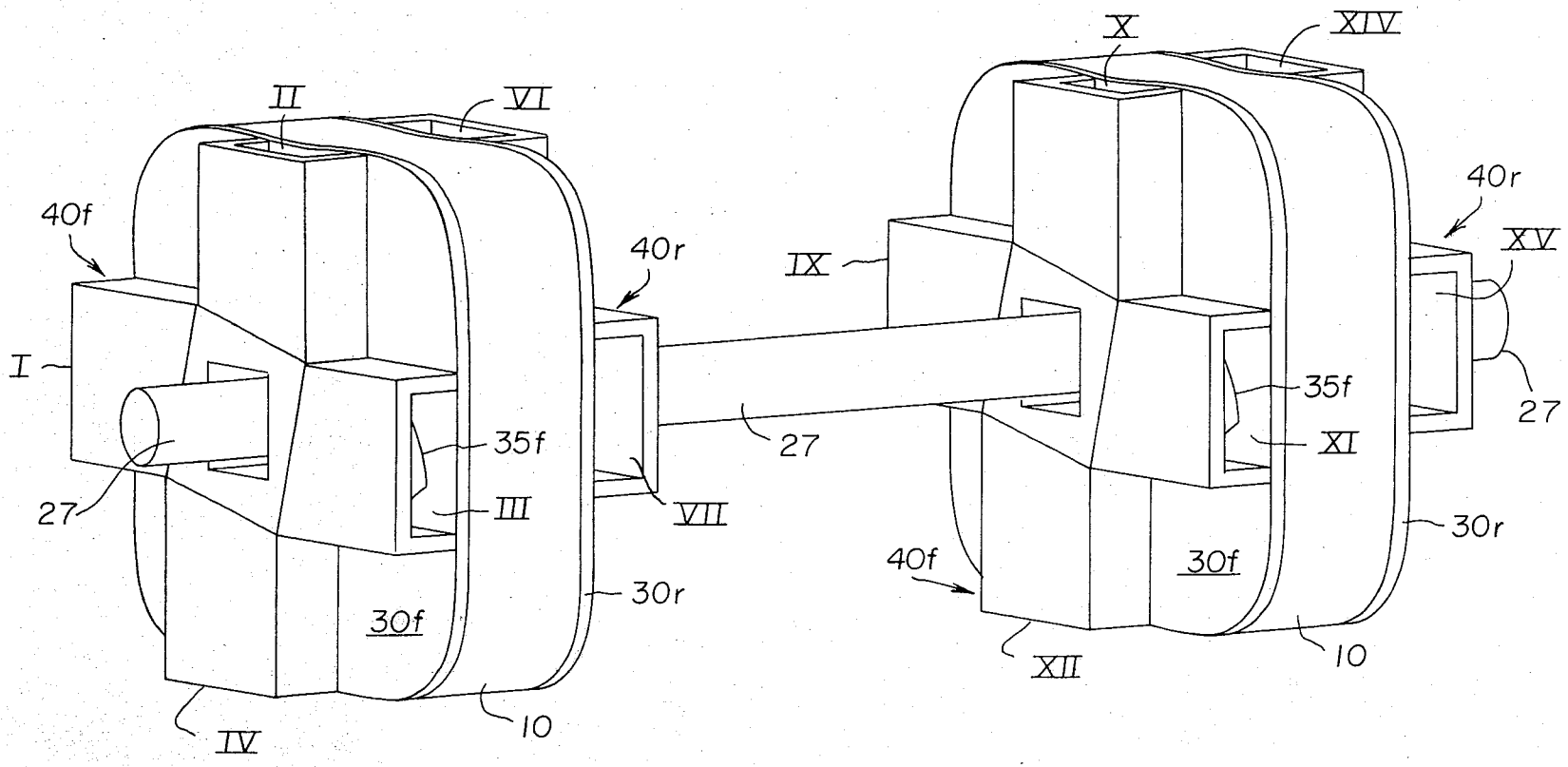
Figure 16:
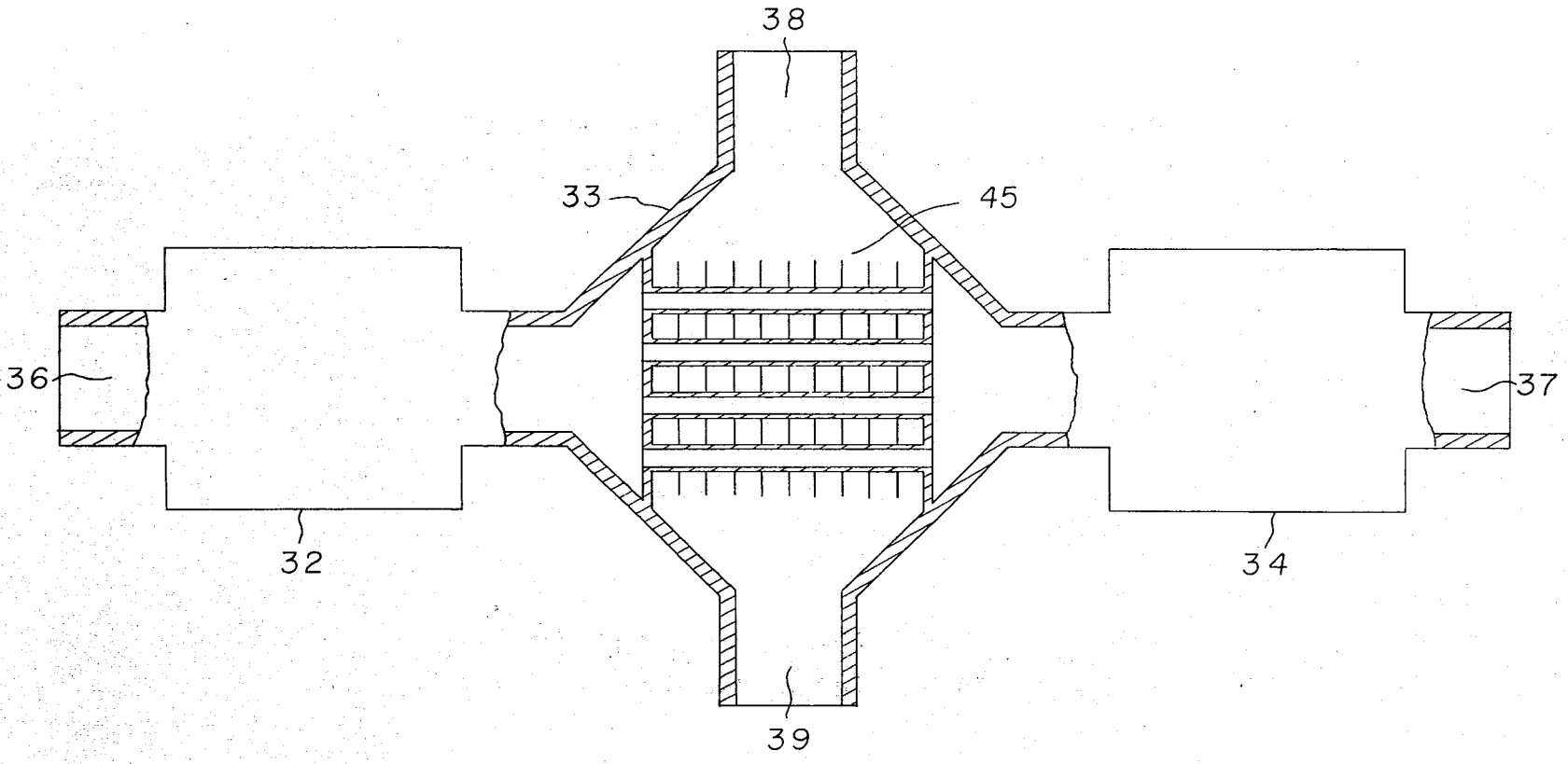
Figure 18:
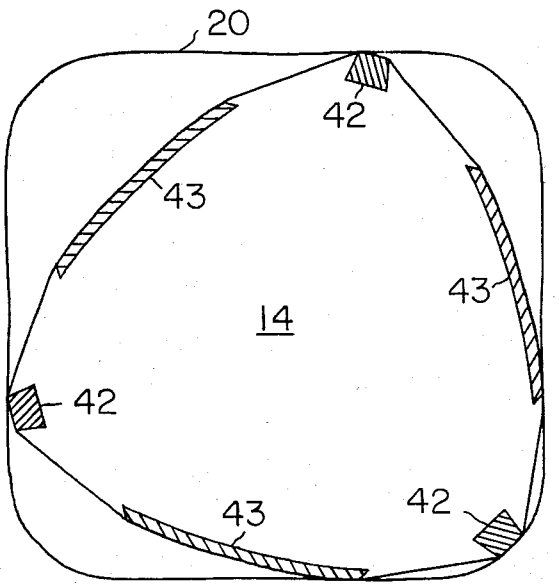
Figure 17:
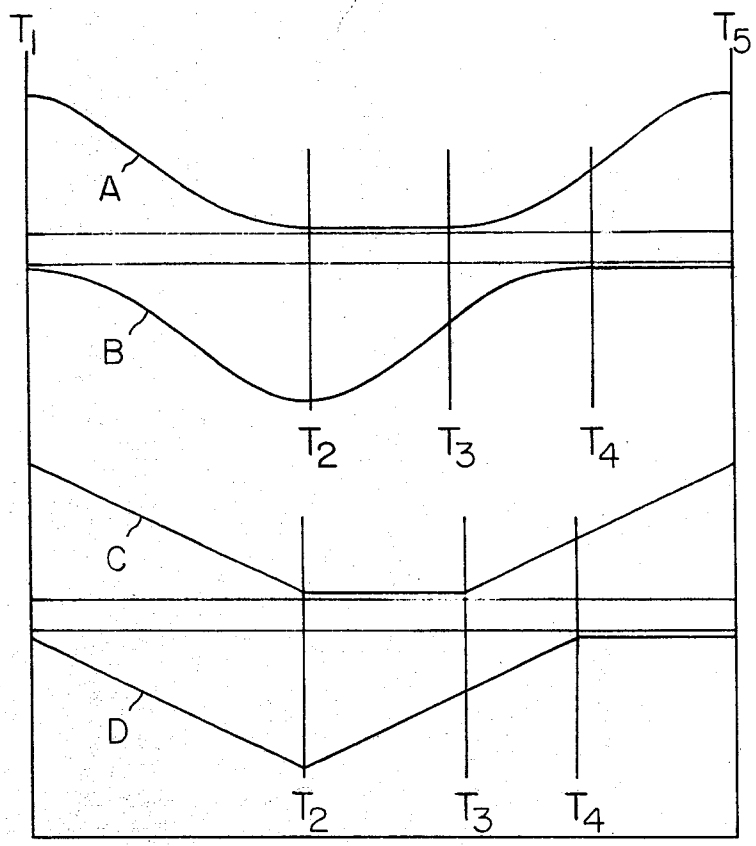

FIGS. 7A, 7B, 7C, 7D, 7E and 7F depict, partly schematically, a rotary mechanism of this invention in which the inner body is shown in six different characterizing incremental positions of rotational travel within the outer body cavity, and illustrate, inter alia, the principles of continuous sealing engagement between the apex portions of the inner body and the inner peripheral wall of the cavity, non-sealing engagement between the connecting portions of the inner body and the inner peripheral wall of the cavity, and periodic sealing engagement between the median portions of the inner body and the inner peripheral wall of the cavity, these Figures also illustrating the utilization of internal gearing constraints in accordance with further preferred embodiments of this invention;

FIGS. 8A, 8B, 8C, 8D, 8E and 8F illustrate in progressive fashion the manner by which the axial profiles of the outer surface of an inner body and the inner surface of the peripheral wall of the outer body cavity may be derived for the rotary mechanism of this invention;

FIGS. 9A, 9B, 9C, 9D, 9E and 9F depict schematically a rotary mechanism as in FIGS. 7A through 7F in which the inner body is shown in the same respective six different characterizing incremental positions of rotational travel, and FIGS. 9A through 9F illustrate, inter alia, the cooperation between one port and one porting channel positioned at one axial end of the mechanism and the cooperation between one port and one porting channel positioned at the other axial end of the mechanism;

FIGS. 10A, 10B and 10C represent, respectively, a frontal cross-section, a median cross-section and an aft cross-section of a preferred inner body of this invention having six discrete porting channels, three such channels being positioned at one of the axial ends of the inner body and other three channels being positioned at the other axial end of the inner body;

FIG. 11 is a pictorial view in perspective of a preferred rotary mechanism of this invention having at each axial end a plate containing a plurality of port openings and having an inner body with a configuration and porting channel arrangement essentially as depicted in FIGS. 10A, 10B and 10C, FIG. 11 being partially exploded and broken away in order to expose the interior of the mechanism;

FIG. 12 is an orthographic projection of the rotary mechanism essentially as depicted in FIG. 11;

FIG. 13 schematically depicts various stages of rotary motion occurring simultaneously in two mechanisms of this invention working in concert with each other as a Stirling cycle engine, the top row (FIGS. 13A through 13H inclusive) representing one rotary mechanism and the lower row (FIGS. 13AF through 13HF inclusive) representing the other rotary mechanism;

FIG. 14 schematically depicts various stages of an ideal Stirling cycle heat engine, FIGS. 14A through 14H being correlated in cycle stages with the cycle described in the corresponding pair of Figures of FIG. 13 positioned thereabove;

FIG. 15 is a pictorial view in perspective of a pair of rotary mechanisms of this invention operatively connected to a common drive shaft and arranged to function in concert with each other as a Stirling engine volume displacer in the manner schematically depicted in FIG. 13, each rotary mechanism having the basic configuration of the mechanism shown in FIG. 11;

FIG. 16 is an elevation, partly in section, of a heat transfer assembly composed of heat rejection means, regenerator means, and heat addition means, a plurality of such assemblies being utilizable with a Stirling engine volume displacer depicted in FIG. 15 in the construction of a Stirling cycle engine of this invention;

FIG. 17 is a volumetric analysis in graphical form comparing the performance characteristics of a rotary mechanism of this invention with the performance characteristics of a Stirling-type volumetric displacer; and FIG. 18 depicts the axial profile of a particularly preferred rotary mechanism of this invention in which each apex portion is composed of a contoured sealing plate having progressive portions of its outer face in sealing engagement with the inner surface of the peripheral wall of the outer body cavity during relative rotation between the inner and outer bodies, and in which each median portion is composed of a contoured sealing plate periodically having progressive portions of its outer face in sealing engagement with said inner surface during said relative rotation.

In the Figures like numerals represent parts of like character. Inasmuch as the Figures themselves make clear that the same parts frequently appear in many different Figures and that even in a single Figure there is frequently shown a plurality of identical parts (e.g., apex portions, median portions, connecting portions, inner bodies, profiles, etc.), numeration is applied only to a representative number of such parts in order to avoid undue repetition of numeration in the Figures.

Referring to the Drawings it will be seen that the mechanisms of this invention include an outer body 10 having therein a cavity 12 in which is positioned an inner body 14. Outer body 10 and inner body 14 are adapted to undergo relative rotation with respect to each other. In this rotary system the axis 13 of inner body 14 is spaced from but parallel to the axis 11 of cavity 12 (note in this connection FIGS. 1 through 6 inclusive). Inner body 14 has a cross sectional profile composed of a plurality of apex portions 15, a plurality of median portions 17 and a plurality of connecting portions 19. Each apex portion 15 is equally spaced about and is equidistant from the axis of inner body 14. As shown, for example, in FIGS. 1 through 6 it is preferred that in a given mechanism apex portions 15 each have essentially the same contour although this is not essential. Similarly, each median portion 17 is equally spaced about is equidistant from the axis of inner body 14 and preferably, although not necessarily, all of the median portions of a given mechanism have essentially the same contour (note, for example, FIGS. 1 through 6). It will be seen that each median portion 17 is positioned between—preferably, equidistantly between—and is spaced apart from two apex portions 15. A connecting portion 19 lies between and joins together a median portion 17 and an apex portion 15.

The inner surface or profile 20 of the peripheral wall of outer body 10 defines the cross sectional configuration of cavity 12. From FIGS. 1 through 6 it can be seen that the general configuration of profile 20 is such that it is composed of a plurality of sides or segments one greater in number than the total number of apex portions 15 present on the inner body 14 employed.

Figure 2:
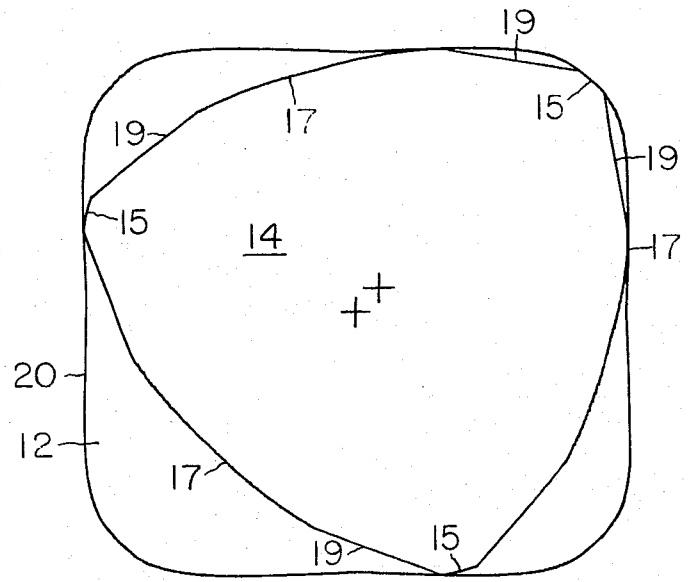
FIG. 2 depicts the axial profile of a preferred rotary mechanism of this invention having an inner body with three apex portions and a four-sided outer body cavity.
Figure 1:
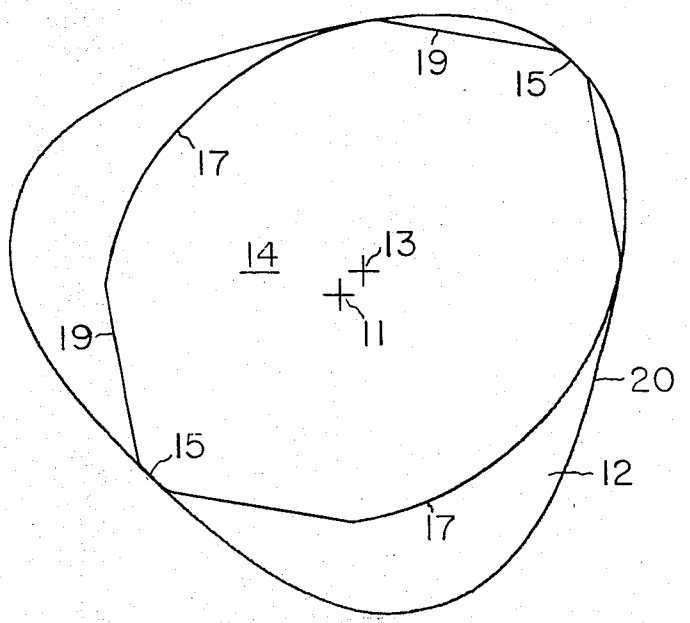
FIG. 1 depicts the axial profile of a rotary mechanism of this invention having an inner body with two apex portions and a three-sided outer body cavity.
Figure 4:
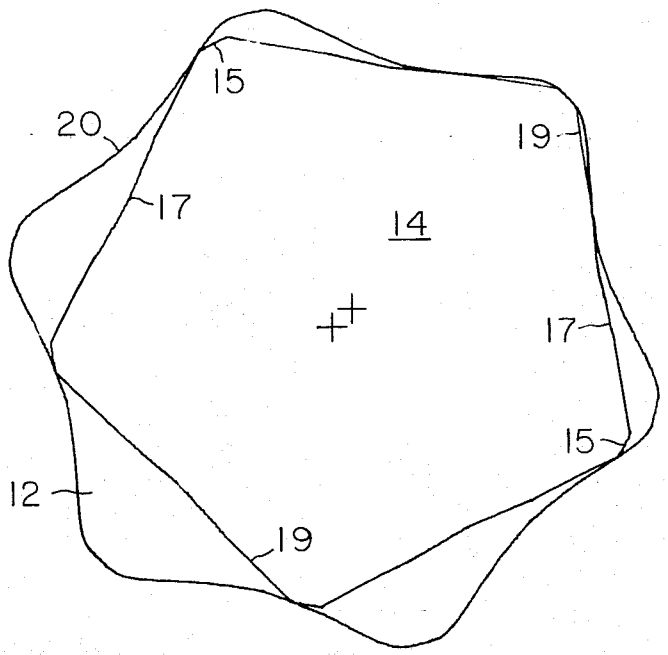
FIG. 4 depicts the axial profile of another preferred mechanism, in this instance one having an inner body with five apex portions operatively positioned within a six-sided outer body cavity.
Figure 3:
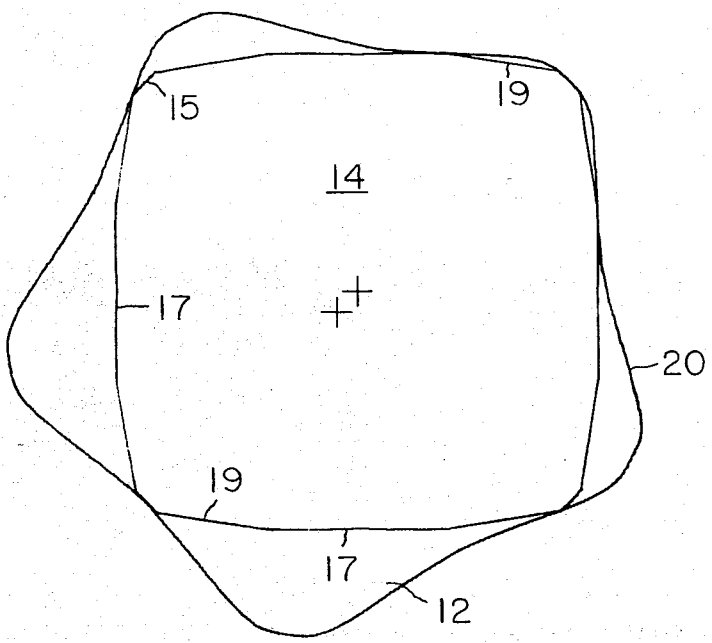
FIG. 3 is similar to FIG. 2 but depicts a preferred mechanism in which the inner body has four apex portions and the outer body has a cavity with five sides.
Figure 6:
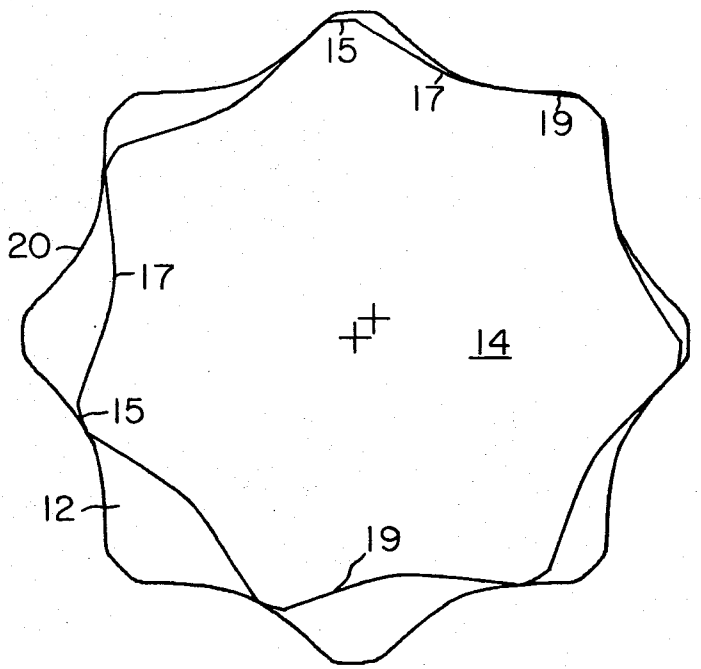
FIG. 6 depicts the axial profile of a rotary mechanism of this invention in which the rotor has seven apex portions and the outer body cavity has eight sides.
Figure 5:
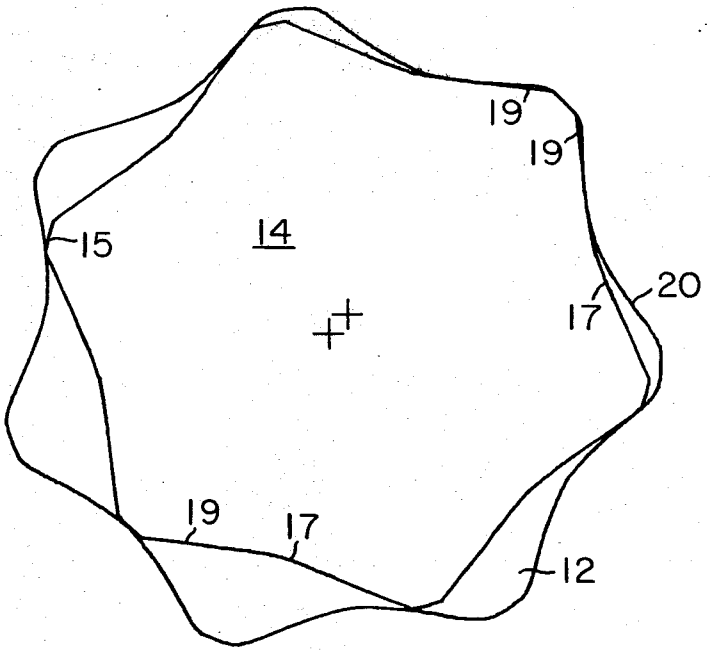
FIG. 5 is similar to the preceding Figures and depicts the profile of still another preferred mechanism, i.e., one with an inner body having six apex portions and a generally seven-sided outer body cavity.
Figure 7A:
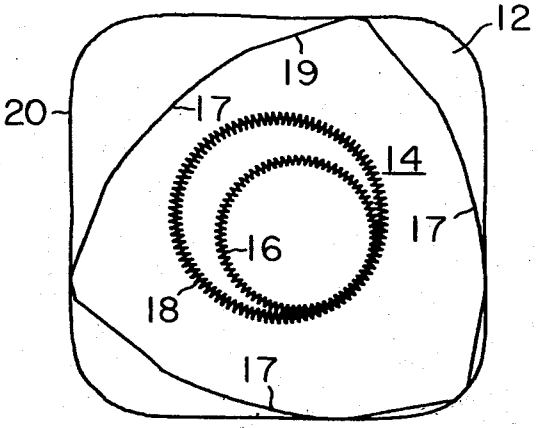
Figure 7B:
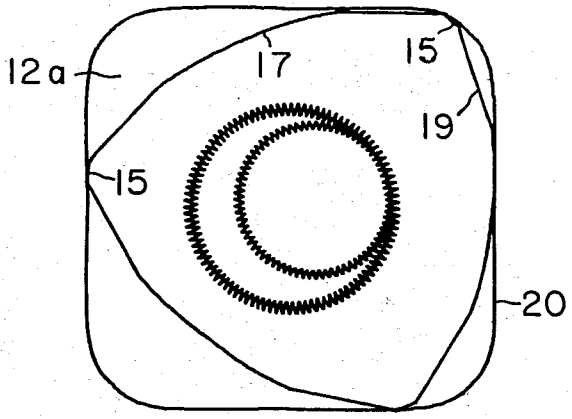
Figure 7C:
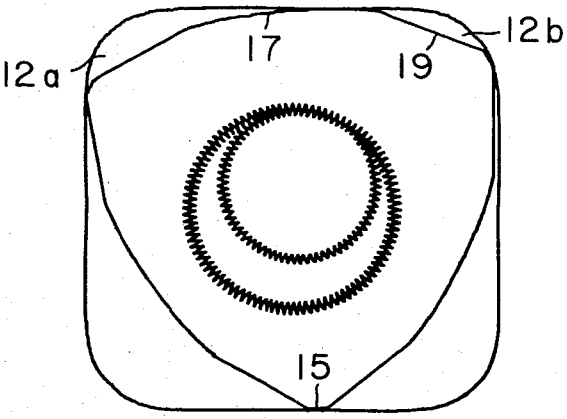
Figure 7D:
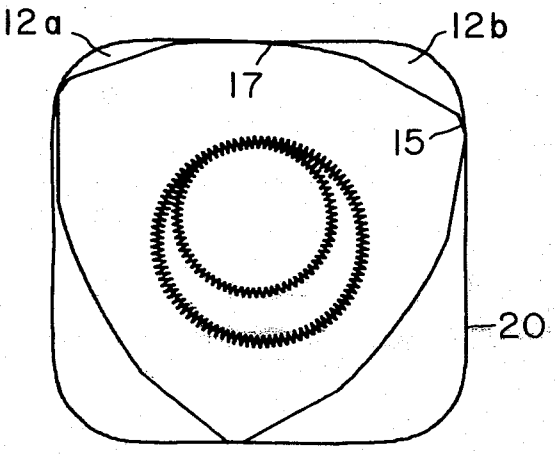
Figure 7E:
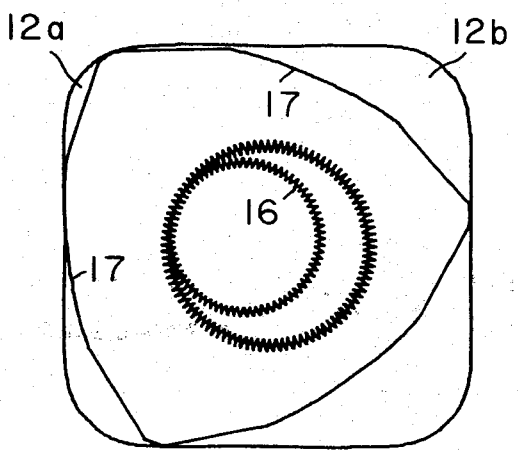

FIGS. 7A through 7F make clear that each apex portion 15 is in continuous sealing engagement with profile 20 during relative rotation of outer body 10 and inner body 14 about their respective axes. The same Figures also show that each given median portion 17 is periodically in sealing engagement with profile 20 and periodically at other times during the relative rotation is disengaged from profile 20. By way of example, in FIG. 7A median portion 17 shown therein in the upper left quadrant of cavity 12 is disengaged from profile 20. In FIG. 7B this same median portion remains disengaged from profile 20 but by virtue of its clockwise rotation has moved to a position where sealing engagement with profile 20 is about to occur. FIGS. 7C and 7D show this same median portion in progressive stages of its periodic sealing engagement with profile 20. In FIG. 7E this same median portion is no longer in sealing engagement with profile 20, disengagement therebetween having just occurred as a result of the relative rotation. It will thus be readily apparent that as the relative rotation continues this same median portion 17 remains disengaged from profile 20 for a given portion of the rotational travel (note FIG. 7F) and thereafter sealing engagement reoccurs in the same general cyclical manner. It will also be evident from FIGS. 7A through 7F that in a preferred embodiment in which the median portions of inner body 14 all have essentially the same contour (as shown), at all times during the relative rotation of bodies 10 and 14 at least one of the median portions is undergoing periodic sealing engagement with profile 20. This is possible by virtue of the fact that in such a mechanism a median portion begins its periodic sealing engagement at a point in time when some other median portion is about ready to begin its periodic disengagement from sealing engagement.

Still another feature readily apparent from FIGS. 7A through 7F is the fact that connecting portions 19 do not involve any sealing engagement with profile 20 at any stage of the relative rotation of bodies 10 and 14. Thus, connecting portions 19 may have any cross sectional configuration, including an essentially flat surface or any surface recessed in any suitable manner therefrom, so long as the connecting portion does not intercept profile 20 in such a manner as to restrict the rotary motion between bodies 10 and 14. By the same token the configurations of the connecting portions of a given inner body 14 need not be identical to each other although the use of a symmetrical, well-balanced inner body 14 is generally preferred.

A particularly significant feature of this invention is the fact that by virtue of the periodic sealing engagement and disengagement which each median portion 17 undergoes with profile 20, unique and highly advantageous volume displacement characteristics are exhibited during relative rotation between inner body 14 and outer body 10. For example, during this relative rotation the variable volume chambers defined by the outer wall of inner body 14 and profile 20 periodically undergo subdivision or partition whereby a pre-existing single chamber is transformed into two chambers which as a result of further rotation are subsequently merged or reunited so that a single chamber is again formed. This feature can be observed by reference for example to FIGS. 7B, 7C, 7D and 7E. In FIG. 7B, chamber 12*a* is defined at its lateral extremes by sealing engagements between profile 20 and the two proximate apex portions 15. No sealing engagement involving the proximate median portion 17 exists in FIG. 7B. However, in reaching the position depicted in FIG. 7C, chamber 12*a* has been subdivided into two smaller chambers 12*a* and 12*b* through the sealing engagement which has taken place between said proximate median portion 17 and profile 20. In passing from the position shown in FIG. 7D to that shown in FIG. 7E, chambers 12*a* and 12*b* (FIG. 7D) have been merged into a single larger chamber 12*b* (FIG. 7E).

Figure 7F:
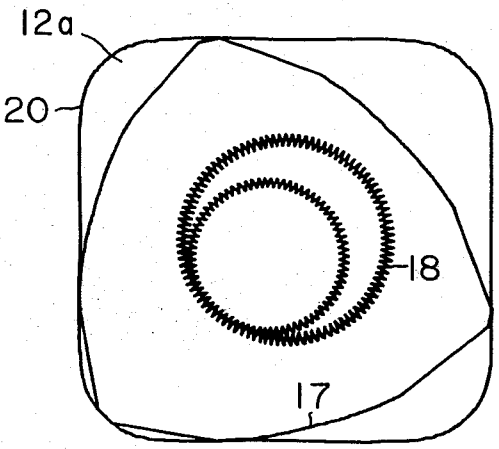

It will be noted from FIG. 7E that a new chamber 12*a* has just been created as a result of sealing engagement involving a different median portion 17 and that after passing through, inter alia, the respective sequential stages depicted in FIGS. 7F and 7A this chamber becomes a chamber like 12*a* of FIG. 7B that undergoes subdivision into the smaller chambers 12*a* and 12*b* shown in FIGS. 7C and 7D.

FIGS. 7A through 7F illustrate yet another preferred feature of this invention—the utilization of internal gearing constraints. More specifically, small gear or pinion 16 which is axially positioned relative to and coaxially aligned with inner body 14 is engaged with and adapted to rotate around in trochoidal fashion the matching geared internal periphery of internally toothed ring gear 18 which is axially positioned relative to and coaxially aligned with the outer body cavity 12. It will be appreciated that pinion 16 and ring gear 18 as schematically shown in FIGS. 7A through 7F will normally be positioned beyond one axial end of the outer body 10 and its cooperating inner body 14 (i.e., closer to the viewer of FIGS. 7A and 7F inclusive than the section or profile view of cavity 12 and inner body 14 depicted in FIGS. 7A through 7F) and that for best results another pinion 16 and ring gear 18 will be positioned beyond the other axial end of the same outer body 10 and the same inner body 14 (i.e., farther away from the viewer of FIGS. 7A through 7F inclusive than said section or profile view). Thus, in such case the two pinions 16 and the inner body 14 will all be coaxially aligned and the inner body will occupy a zone or locus in between the zones or loci of the pinions 16 fore and aft of the inner body. Each pinion (whether there are two as just described, or only one) is attached by means of a shaft (not shown in FIGS. 7A through 7F, but see crankshaft 27 of FIG. 15 which may be used for this purpose) to inner body 14 so that each such pinion, each such shaft and the inner body rotation as a single unit. Ring gear 18, irrespective of whether there are one or two of them, is preferably mounted so as to be held in a static or stationary position (i.e., it preferably does not itself rotate, although arrangements are feasible where it does rotate relative to the pinion). Where two ring gears 18 are utilized, these and the outer body cavity will all be coaxially aligned with each other and the outer body will occupy a zone or locus in between the zones or loci of the ring gears 18 fore and aft of the outer body. For ease in representation pinion 16 and ring gear 18 are depicted in these Figures in the form of saw-toothed gears although in practice any suitable type of meshing gears permitting the desired trochoidal rotation may of course be used.

As will now be apparent from FIGS. 7A through 7F, the relative trochoidal rotation between pinion 16 and its ring gear 18 is arranged—through proper sizing, positioning and adjusting of these elements—to impose a constraint upon the simultaneous relative trochoidal rotation between inner body 14 and outer body 10 taking place within the cavity 12. In other words, rotational forces which in the absence of this constraint might tend to cause premature wear of the contacting portions of the inner wall of the outer body and apex and/or median portions of the inner body are kept under control and partially dissipated through interaction between the pinion and its ring gear. Hence, as used herein the term "internal gearing constraint" is employed to signify this general type of constraint—"internal" being used in the sense that the constraint is imposed on the pinion by virtue of its positioning within the ring gear, which constraint is at least in part imposed mechanically upon the inner body as it simultaneously rotates within the outer body cavity. Naturally one could equally well consider the constraint "external" by viewing the constraint as being imposed upon the ring gear by virtue of its external positioning relative to the pinion. In any event, it will be seen that by use of such gearing constraints stress concentrations at seal locations between inner body 14 and profile 20 can be controlled. In fact, with proper machining such bearing stress may all but eliminated and the seals between inner body 14 and profile 20 maintained by means of a lubricant film alone.

Figure 8A:
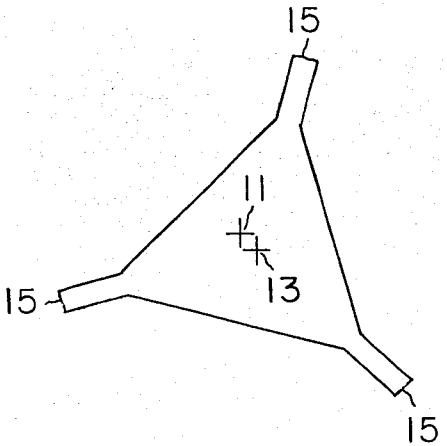
Figure 8B:
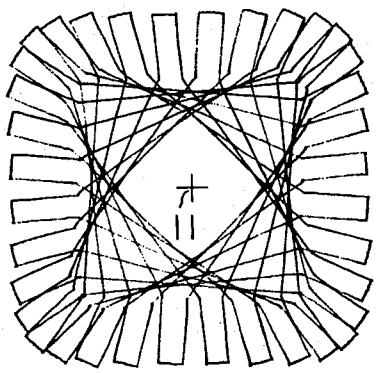
Figure 8C:
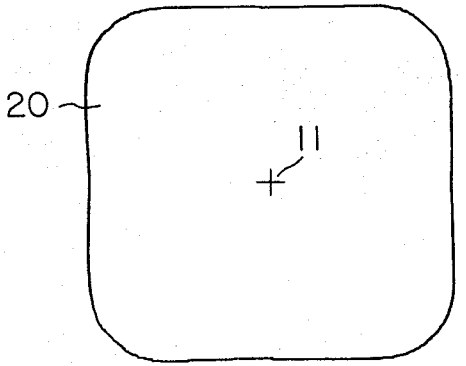
Figure 8D:
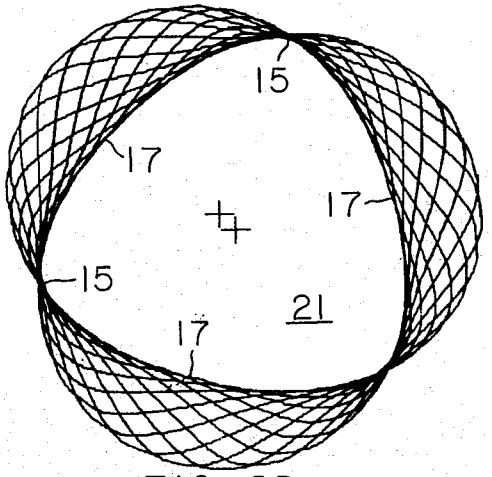
Figure 8E:
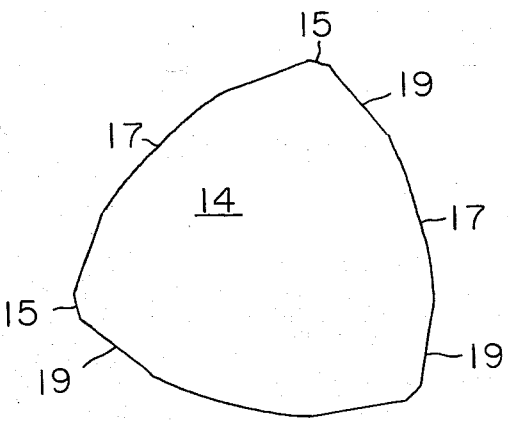
Figure 8F:
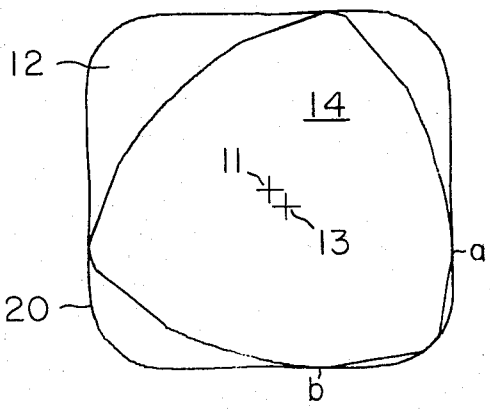

FIGS. 8A through 8F inclusive illustrate a way by which preferred geometrical configurations may be generated in designing the systems of this invention. Although these particular Figures illustrate the technique with reference to a system having three apex portions 15, the same general technique can readily be applied in generating preferred configurations for systems having any suitable number of apex portions. In the preferred embodiments of this invention embodying these preferred geometrical configurations, the inner surface of the peripheral wall of the outer body cavity has essentially the profile defined by the radially outermost points in the family of hypotrochoidal curves traced by the series of points describing an apex portion of the inner body, the tracing occurring as said inner body is rotated in a trochoidal manner with the base reference being the axis of the outer body. As a corollary to this, in these preferred embodiments the outer surface of the inner body (with the exception of the connecting portions) has essentially the profile defined by the radially innermost points in the family of epitrochoidal curves traced by the series of points describing the inner surface of the peripheral wall of the outer body cavity, the tracing occurring as the outer body is rotated in a trochoidal manner with the base reference being the axis of the inner body. To illustrate the foregoing, FIG. 8A shows a body of arbitrary configuration except for having three apex portions 15 equally spaced about and equidistant from the axis 13 of the inner body. Also shown in FIG. 8A is the axis 11 of an outer body cavity to be generated or constructed (geometrically speaking). Axes 11 and 13 are laterally displaced from each other by a suitable arbitrary distance. FIG. 8B shows the result of rotating the foregoing body in a trochoidal manner with the base reference being axis 11, the axis of the outer body whose inner profile (cavity) is being generated. For convenience of illustration, a limited number of sequential positions of the foregoing body are shown in this Figure. It will be understood that a great many more such positions can be selected in order to achieve very close increments of rotational travel to give points for tracing purposes. FIG. 8C shows the tracing that results by connecting (tracing) the radially outermost points on the apex portions 15 in each and every one of the positions of rotation utilized in this generation technique. This tracing represents profile 20 of the outer body cavity. The next step in this conceptual or geometrical process is to consider profile 20 as the cavity of a tangible body whose configuration except for the profile is of no consequence for present purposes. Suffice it to say that this outer body is now rotated in a trochoidal manner with the base reference being axis 13 of the inner body. FIG. 8D shows profile 20 as it is positioned during a selected number of sequential positions during this rotation. Here again, a great many more positions in between those shown could be included to give more points for tracing purposes. Even so, it will be seen from FIG. 8D that by connecting (tracing) the radially innermost points in this family of epitrochoidal curves there is defined the exterior profile of a symmetrical three-sided shape 21 having three apex portions 15 coinciding for all intents and purposes with those of FIG. 8A. Shape 21 also has median portions 17 and it constitutes in effect a precursor of the inner body of the system being generated. It will be recalled that the connecting portions between the apex portions 15 and the median portions 17 must not make sealing contact with profile 20. Accordingly, FIG. 8E shows one of a multitude of ways by which shape 21 is transformed into inner body 14 through radial attenuation of shape 21 in the regions where the connecting portions are to be. In the form depicted connecting portions 19 of inner body 14 are essentially linear segments connecting (extending between) adjacent edges of an apex portion 15 and a median portion 17. FIG. 8F depicts this inner body 14 positioned within the profile 20 of the outer body cavity 12, the outer body itself not being shown since as mentioned above the only important part thereof for present purposes is its inner peripheral wall.

It will be noted that in the relative positions shown in FIG. 8F the inner body 14 and profile 20 define five cavities therebetween, FIG. 8F showing one of several rotational positions where in these preferred systems two sealing engagements simultaneously exist between two different median portions (note points *a* and *b* therein which in practice in a three dimensional system of this invention would of course represent linear seals extending in axial directions). Since the apex portions are always in sealing engagement with profile 20 these three seals (since there are three apexes in the embodiment depicted) plus the seals at *a* and *b* (as shown) give five seals in the position shown in FIG. 8F which in turn give rise to the five cavities shown. During the greater portion of the rotational travel in a system having three apexes there will exist four cavities, five cavities periodically coming into existence when an apex portion is centered in a "corner" of profile 20 (as shown in FIG. 8F) and then one of these vanishing as the relative rotation progresses. The vanished cavity, of course, loses its individual or discrete identity through merger with an adjacent cavity. Similar considerations apply in the systems of this invention having two, or four or more apex portions although the numbers of cavities in each case will differ. For example, in a system having two apex portions there will normally be three cavities and periodically a fourth cavity will have transitory existence.

Still another of the features of this invention is the highly advantageous porting relationships which are readily utilized in practicing other preferred embodiments of the systems as described herein. These porting relationships, which enable periodical opening and closing of the variable volume cavities in relation to the exterior of the outer body cavity, are illustrated in FIGS. 9A through 9F, 10A through 10C, 11 and 12. These Figures deal with a three-apex system of this invention but it will be understood and appreciated that the principles illustrated thereby apply and can readily be adapted to the systems of this invention having two or four or more apex portions.

Turning first to FIG. 11 it will be seen that in accordance with this invention a preferred porting system in a rotary mechanism of this invention involves having at each axial end thereof a ported plate 30 enclosing the ends of the variable volume chambers. Except for the ports and channeling to be referred to hereinafter, the interior faces of plates 30 are in slidable or sealing relationship with the axial ends of inner body 14. Hence, thin film lubricants, ring-type sealing means or any other type of suitable sealing arrangement or material may be used between these relatively moving surfaces if desired. The number of ports 35 present in each ported plate 30 will normally be one greater than the number of apex portions 15 present on the inner body 14. The number of porting channels 25 present at each axial end of the inner body will normally be equal to the number of apex portions 15 present on the inner body 14. Ports 35 are radially disposed around and are equidistant from the axis of outer body cavity 12. In general, these ports are more or less uniformly spaced from each other and are positioned to periodically be in registration with porting channels 25 in inner body 14 during operation of the rotary system.

Turning now specifically to FIGS. 9A through 9F only one such port and one such channel at each end of the depicted system are represented, this being done in the interests of simplifying these particular views and facilitating an understanding of the relationships involved. In practice, however, there are a plurality of ports and channels at each axial end (note FIG. 11). In FIGS. 9A through 9F a port 35 cut through end plate 30 (not shown) at the axial end of the system closer to the viewer is identified as 35f and a channel 25 cut into the face of the inner body 14 closer to the viewer is identified as 25*f*, the letter *f* in 25*f* and 35*f* in FIGS. 9A through 9F as well as in FIGS. 10A and 12 signifying that these elements are at the "front" axial end of the rotary unit (or port) depicted. Similarly, in FIGS. 9A through 9F a port 35 cut through end plate 30 (not shown) at the axial end of the system farther away from the viewer is identified as 35*r* and a channel 25 cut into the face of the inner body 14 farther away from the viewer is identified as 25*r*, the letter *r* in 25*r* and 35*r* in FIGS. 9A through 9F as well as in FIG. 10C and 12 signifying that these elements are at the "rear" axial end of the rotary unit (or part) depicted. In the interest of facilitating a consideration of FIGS. 9a through 9F (and also FIG. 12) ports 35*f* and channels 25*f* are shown in solid lines and ports 35*r* and channels 25*r* are shown in dotted lines. The face of inner body 14 carrying channels 25*f* is in slidable or sealing relationship with the inner face of the plate 30 which is at the "front" axial end of the rotary unit and the face of inner body 14 carrying channels 25*r* is in slidable or sealing relationship with the inner face of the plate 30 which is at the "rear" axial end of the rotary unit. Thus, all of the variable volume chambers shown in FIGS. 9A through 9F (and in FIG. 12) such as 12*a*, etc., are isolated from each other by the combination of (i) the sealing engagement between the inner wall or profile 20 of outer body 10 and the apex portions and, periodically, the median portions of inner body 14 and (ii) the sealing relationships or slidable contacts existing between the interior axial end faces of plates 30 and the proximate axial end faces of inner body 14. Consequently, compressible working fluid can be caused to enter or leave from these variable volume chambers 12*a*, etc. either when a channel 25*f* is in registry with a port 35*f* or a channel 25*r* is in registry with a port 35*r*. At other times during the relative rotation between inner body 14 and outer body 10 when such registry does not permit ingress or egress of such fluid from a particular variable volume chamber, the working fluid contained therein is either expanded or compressed depending on whether the chamber in question is being increased or decreased in volume at the given stage of the relative rotation.

In FIGS. 9A through 9F there are shown individual states of progressive clockwise relative rotation of inner body 14 within profile 20, "clockwise" being used in the sense that from the axial end of the system as viewed in these Figures, inner body 14 rotates trochoidally about its own axis in a generally clockwise direction. When viewed from the opposite axial end this same relative rotation would take place in a generally counterclockwise direction. In the stage shown in FIG. 9A there is no registry between channel 25*f* and port 35*f* nor between channel 25*r* and port 35*r*, however, registry between 25*f* and 35*f* is just ready to occur. Thus, in FIG. 9A chamber 12*a* is in a closed or fully sealed position. On rotating to the position shown in FIG. 9B, port 35*f* has opened due to the registry between 25*f* and 35*f*, the size of the opening at this stage being extensive. During the rotation from FIG. 9A to FIG. 9B no registry has occurred between 25*r* and 35*r* despite their relatively close proximity to each other throughout this portion of the rotation. The volume of chamber 12*a* has been decreased on going from FIG. 9A to FIG. 9B. On proceeding from the position of FIG. 9B to the position of FIG. 9C port 35*r* has opened through registry which has occurred between 25*r* and 35*r*, port 35*f* has remained open through continuing registry between 25*f* and 35*f*, chamber 12*a* has been further diminished in volume, and a new chamber 12*b* has been formed and has started to increase in volume. It will be seen that at about the time chamber 12*b* came into existence as a separate chamber, registry commenced between channel 25*r* and port 35*r*. On proceeding from FIG. 9C to the stage depicted in FIG. 9D, ports 35*f* and 35*r* have remained open with the opening between 25*f* and 35*f* having decreased in size preparatory to closing while the size of the opening between 25*r* and 35*r* has increased. In addition, chamber 12*b* has continued to grow and chamber 12*a* has continued to decrease in volume. On going from the position of FIG. 9D to that shown in FIG. 9E, port 35*f* has closed, port 35*r* has remained open with the opening having grown in size, chamber 12*b* has continued to grow in volume, and chamber 12*a* has vanished through merger into chamber 12*b*. It will be seen that at about the time chamber 12*a* went out of existence as a separate chamber, port 35*f* closed. On proceeding in rotation from the stage of FIG. 9E to that of FIG. 9F, port 35*f* has remained closed and port 35*r* has just closed so that chamber 12*b* is in a closed or fully sealed position. In addition, chamber 12*b* has grown further in volume.

FIGS. 10A, 10B and 10C bring out in greater detail the three-dimensional configuration of inner body 14 and particularly the relative spatial positioning of the channels at the opposite axial ends thereof. It will be recalled that FIGS. 10A, 10B and 10C are cross-sections. The cross-section of FIG. 10A is taken at the "front" axial end of inner body 14, i.e., the axial end closer to the viewer. However, the same general cross-section of FIG. 10A exists over a finite zone on proceeding from the "front" axial end of inner body 14 toward the median cross section depicted in FIG. 10B, the depth of this finite zone depending upon the depth of the channels 25*f*. Likewise, the cross section of FIG. 10B is taken across the middle of inner body 14, i.e., half-way between its "front" axial end (FIG. 10A) and its "rear" or "aft" axial end (FIG. 10C). But here again, the same general cross section of FIG. 10B exists over a finite zone—i.e., it extends a given distance toward the viewer from the median plane on which the section of FIG. 10B is taken and it extends a given distance away from the viewer from the median plane on which the section of FIG. 10B is taken. FIG. 10C represents the cross section taken at the "rear" axial end of inner body 14, i.e., the axial end farther from the viewer. However, once again the same general cross section of FIG. 10C exists over a finite zone on proceeding from the "rear" axial end of inner body toward the median cross section depicted in FIG. 10B (and thus toward the viewer), the depth of this finite zone depending upon the depth of the channels 25*r*. Normally the depth and configuration of channels 25*f* and 25*r* are the same, the difference being in their spatial orientations in and with respect to the inner body 14. This spatial orientation can perhaps be most simply visualized by considering the sections shown in FIGS. 10A, 10B and 10C as three-dimensional flat pieces each having the same thickness. The "piece" of FIG. 10A has the outline of FIG. 10A, the "piece" of FIG. 10B has the outline of FIG. 10B and the "piece" of FIG. 10C has the outline of FIG. 10C. Now the reader is asked to mentally assemble these three pieces into a sandwich construction with the "piece" of FIG. 10B being in between the "pieces" of FIGS. 10A and 10C with all pieces keeping the same angular orientation as the cross sections as shown in FIGS. 10A, 10B and 10C. This will enable the reader to visualize a three-dimensional model illustrative of an inner body 14. It will thus be apparent that there is no direct contact between any channel 25*f* and any channel 25*r* since even though they overlie each other they are axially separated from each other by a distance corresponding in the case of this visualized three-dimensional model by the thickness of the "piece" of FIG. 10B which in effect serves as a wall axially separating the channels 25*f* and the channels 25*r*. It will also be apparent from this visualized model that in orientation, axially separated channels 25*f* and channels 25*r* are, in the case of the three-apex systems, aligned so that their longitudinal axes orthographically criss-cross each other in axially separated fashion. For example, the longitudinal axis of channel 25*f* in the lower portion of FIG. 10A and the longitudinal axis of channel 25*r* in the lower portion of FIG. 10C orthographically criss-cross each other. The same holds true for the longtitudinal axes of channel 25*f* in the upper left quadrant of FIG. 10A and of channel 25*r* in the upper left quadrant of FIG. 10C. And this is likewise true for the longitudinal axes of channel 25*f* and of channel 25*r* in the upper right quadrants of FIGS. 10A and 10C, respectively. This axially separated orthographic criss-crossing of these longitudinal axes and, more importantly, the relative orientation and positioning of all of the channels 25*f* and 25*r* and of all of the ports 35*f* and 35*r* will now be easily perceived by inspection of FIG. 12.

Figure 9A:
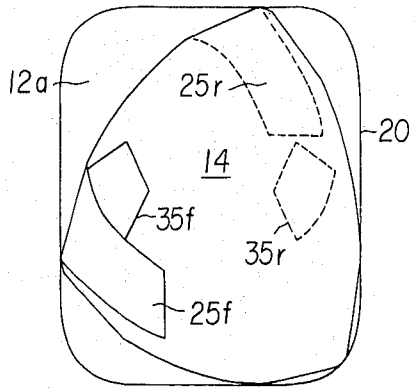
Figure 9B:
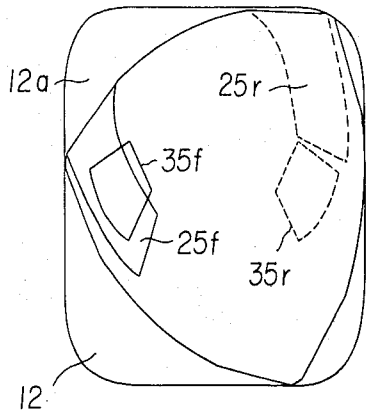
Figure 9C:
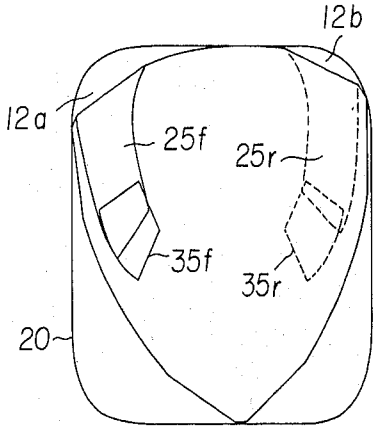
Figure 9D:
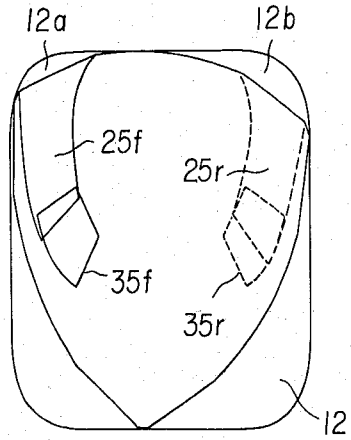
Figure 9E:
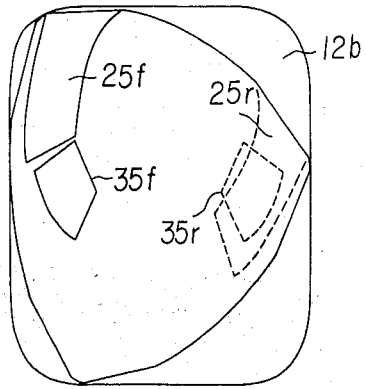
Figure 9F:
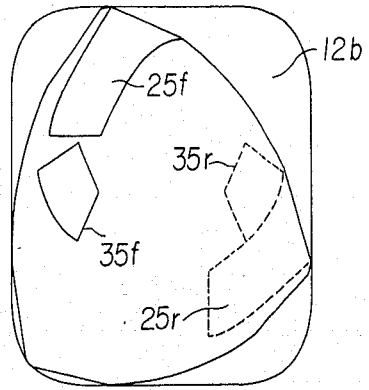

In FIG. 12, inner body 14 is shown in the same position as FIG. 9A but in FIG. 12 all six channels and all eight ports of the rotary system are depicted. It will be seen from FIG. 12 that in the embodiment depicted each of the channels 25*f* is longitudinally adjacent one of the connecting portions 19 associated with a given apex portion 15 and that each of the channels 25*f* has its open end or mouth facing the other connecting portion 19 associated with that given apex portion 15. Note for example channel 25*f* in the lower right quadrant of the Figure—this channel 25*f* runs roughly parallel to the connecting portion 19 which is to its right-hand side in the Figure and this same channel 25*f* directly faces or opens into the connecting portion 19 which in this Figure serves to define the open end of that channel 25*f*. The same relationship with respect to the proximate connecting portions holds true for each of the other two channels 25*f* and for all three channels 25*r* of FIG. 12 as well. It will also be seen from FIG. 12 that upon rotation of successive apex portions 15 into a given identical position relative to profile 20, each of the successive channels 25*f* occupies the same position as occupied by its immediate predecessor and, by the same token, each of the successive channels 25*r* occupies the same position as occupied by its immediate predecessor. For example, on rotating the inner body 14 of FIG. 12 in a "clockwise" direction so that the apex portion 15 shown at the top of the Figure is placed into the position of the apex portion shown in the lower right quadrant of the Figure, channels 25*f* and 25*r* proximate to the first-mentioned apex portion will occupy the places presently occupied by the channels 25*f* and 25*r*, respectively, associated with the second-mentioned apex portion. Simultaneously this same "clockwise" rotation of inner body 14 will have caused channels 25*f* and 25*r* proximate to the apex portion shown on the left side of the Figure to occupy the respective places vacated by the channels 25*f* and 25*r* shown at the top of the Figure. Thus, a perusal of Figure 12 and application of the principles therein revealed will enable anyone skilled in the art to design and utilize inner bodies having properly oriented channels irrespective of the number of apex portions which such inner bodies possess. In this connection, it will be recalled that inner body 14 of the unit depicted in perspective in FIG. 11 has the channeling shown in more detail in FIGS. 10A, 10B, 10C and 12 and that the porting and channeling of these preferred embodiments are illustrated collectively by FIGS. 9A through 9F, 10A through 10C, 11 and 12.

FIG. 12 also makes clear that in the embodiment depicted each plate 30 (also note FIG. 11) has four ports 35 to cooperate with the three channels 25 at each axial end of inner body 14. As shown, these ports are equally spaced about and equidistant from the axis of the outer body cavity. The radial distance of the ports from the axis of the outer body cavity is sufficient to enable the ports 35 to periodically be in registration with the channels with which they cooperate. Here again, a perusal of FIG. 12 in conjunction with the full disclosure hereof will enable those skilled in the art to design and utilize rotary systems of this invention embodying porting relationships of the type herein disclosed.

From the description presented herein it will be readily apparent that the rotary mechanisms of this invention can be adapted for use in a variety of applications, including pumps, fluid motors, heat engines, compressors and the like. As noted above, an outstanding characteristic of the present rotary mechanisms is their exceptional applicability to Stirling cycle engines. In this field of utility, the rotary mechanisms of this invention possess the unique advantage of having volumetric characteristics closely akin to those of an idealized engine. This becomes apparent from a consideration of FIGS. 13 and 14.

In FIG. 13 are shown in schematic fashion various stages of rotary motion occurring simultaneously in two rotary mechanisms of this invention working in concert with each other as a Stirling engine volume displacer. A view of a typical displacer arrangement utilized in connection with the operation to be described with reference to FIG. 13 is shown in perspective in FIG. 15. In the illustrative embodiment set forth in FIGS. 13 and 15, two rotary mechanisms of the type shown in FIGS. 11 and 12 are placed in spaced apart, tandem relationship with their respective housings (i.e., outer bodies 10) in axial alignment and the inner bodies 14 of both of these rotary mechanisms are rigidly fastened or attached to a common eccentric crankshaft 27. In orientation, the respective inner bodies 14 are attached to the crankshaft 27 in a manner such that one such inner body is at all times angularly displaced 180° relative to the other inner body. Such angular displacement is depicted in FIG. 13 wherein the top row of Figures (i.e., FIGS. 13A through 13H) represents a series of sequential rotary positions for the inner body 14 of one of the rotary units in the tandem relationship and the lower row of Figures (i.e., FIGS. 13AF through 13HF) represents the corresponding sequential rotary positions for the inner body 14 of the other rotary unit in the tandem relationship. It will be noted that in each sequential position shown, the angular displacement between the respective inner bodies remains constant and amounts to 180°. Compare, for example, FIG. 13A with FIG. 13AF, FIG. 13B with FIG. 13BF, FIG. 13C with FIG. 13CF, and so on—in each and every instance the inner bodies are angularly displaced from each other by 180°. Accordingly, the two rotary units are oriented on an eccentric crankshaft in a counterbalancing manner so as to have complete equilibrium of moments about a neutral axis.

In the illustrative embodiment set forth in FIGS. 13 and 15, all of the ports in the plates 30*f* and 30*r* of both rotary mechanisms are positioned as shown orthographically in FIG. 12. In other words, the Stirling engine displacer depicted in FIG. 15 and utilized in FIG. 13 has four ports 35*f* in each of the two plates 30*f*, these ports being in the same positions as ports 35*f* of FIG. 12. Likewise, the displacer of FIG. 15 has four ports 35*r* in each of the two plates 30*r*, these ports being in the same positions as ports 35*r* of FIG. 12. For the most part, the ports 35*f* and 35*r* of FIG. 15 are not shown therein since they are enclosed within manifolds 40*f* and 40*r* to be discussed hereinafter. It will also be understood that the inner bodies enclosed within the two rotary mechanisms of FIG. 15 each have channels equivalent to channels 25*f* and 25*r* as shown in FIG. 12.

In the system depicted schematically in FIG. 13, are included heat rejection means 32 (also sometimes referred to in the art as a low temperature reservoir or heat dump), regenerator means 33 (sometimes referred to in the art as a heat storage device or thermodynamic sponge), and heat addition means 34 (sometimes referred to in the art as a high temperature reservoir or heater).

The operation of the system such as depicted in FIG. 13 (i.e., one in which both inner bodies have three apex portions) involves five concurrently progressing cycles each one of which has four distinct phases, viz., a replenishment phase, a compression phase, a regeneration phase, and an expansion phase. At all times during the operation, all four of these phases are taking place concurrently, each within a different cycle. In addition, one of the phases—replenishment—is taking place concurrently in two of the cycles. The relationships involved are set forth in Table I in which the progressions in the four phases occurring in the five cycles (Cycles A through E) are shown in relation to total degrees of angular rotation of the inner bodies. It will be understood that in an operating engine there will inevitably be a time lag involved for all of a given quantity (control volume) of working fluid to pass from one portion of the engine (e.g., a first chamber) through another portion of the engine (e.g., ports, conduits, heat exchanger, etc.) and into another portion of the engine (e.g., a second chamber). In actual practice, therefore, there are situations where different portions of a control volume of working fluid may actually be undergoing different phases of the cycle at the same time. Hence, the transitions from phase to phase in actual practice are not sharply defined. Accordingly, the description presented hereinafter concerning beginnings and endings of various phases is presented in a somewhat simplified manner (e.g., the effect of such time lag is largely neglected) in order to facilitate an understanding of the essential features of the operation. For example, the phase transitions as a function of angular rotations as set forth in Table I are presented in an illustrative sense are not to be construed as hard and fast dividing lines.

TABLE I

| | Concurrent Phase Progessions in Relation to Angular Rotation | | | | | | | | |
|---|---|---|---|---|---|---|---|---|---|
| | 0° to 90° | 90° to 180° | 180° to 270° | 270° to 360° | 360° to 450° | 450° to 540° | 540° to 630° | 630° to 720° | 720° to 810° |
| Cycle A | Replen. | Replen. | Compr. | Regen. | Expan. | Replen. | Replen. | Compr. | Regen. |
| Cycle B | Expan. | Replen. | Replen. | Compr. | Regen. | Expan. | Replen. | Replen. | Compr. |
| Cycle C | Regen. | Expan. | Replen. | Replen. | Compr. | Regen. | Expan. | Replen. | Replen. |
| Cycle D | Compr. | Regen. | Expan. | Replen. | Replen. | Compr. | Regen. | Expan. | Replen. |
| Cycle E | Replen. | Compr. | Regen. | Expan. | Replen. | Replen. | Compr. | Regen. | Expan. |

Replen. = Replenishment
Compr. = Compression
Regen. = Regeneration
Expan. = Expansion As Table I indicates, the four phases in any given cycle always progress in the sequence: replenishment, compression, regeneration, and expansion. It will also be observed that in the system under discussion the replenishment involves 180° of angular rotation by each of the two inner bodies. On the other hand, each of the other three phases occurs over 90° of angular rotation by the inner bodies. In other words, one complete cycle involves a total of 450° of angular rotation.

Of particular significance is the fact reflected in the Table that at all times the expansion phase is taking place in one of the cycles, the expansion phase constituting the positive work process.

In order to illustrate such operation, FIG. 13 considers in detail the progressions taking place in one of these cycles, the cycle corresponding to Cycle A of Table I. It will be seen that the degrees of angular rotation shown in FIG. 13 are as follows:

| | | |
|---|---|---|
| 13A and 13AF | — | 0° |
| 13B and 13BF | — | 90° |
| 13C and 13CF | — | 180° |
| 13D and 13DF | — | 270° |
| 13E and 13EF | — | 315° |
| 13F and 13FF | — | 360° |
| 13G and 13GF | — | 450° |
| 13H and 13HF | — | 540° |

In the following discussion in which only one of the five concurrently occurring cycles is considered, reference will be made only to those flows, chambers, and associated elements or means which are participating in the cycle being discussed. For example, although FIG. 13 shows many chambers, only certain ones are participating in the cycle under consideration and will be referred to. The other chambers are variously participating in the other cycles.

In beginning the operation of the system as depicted in FIG. 13, a hot compressible working fluid contained in chamber 12*a* of FIG. 13A is transferred through regenerator means 33*a* and into chamber 12af of FIG. 13AF. As the fluid passes through the regenerator means, some of its heat energy is extracted and stored for subsequent use, and consequently, this constitutes the beginning of the replenishment phase. As the inner bodies progressively rotate in tandem in a "clockwise" direction this transfer or flow of the working fluid continues and is enhanced by the progressive decrease in volume of chamber 12*a* (see FIGS. 13A, 13B and 13C) and the progressive increase in volume of chamber 12*af* (see FIGS. 13AF, 13BF and 13CF). Inasmuch as on going from FIGS 13A and 13AF to FIGS. 13C and 13CF, chamber 12*a* continuously and progressively decreases in volume while chamber 12*af* continuously and progressively increases in volume, and inasmuch as the summation of these changing volumes remains relatively constant, the volume displacement characteristics of this system closely approximate the volumetric characteristics of the ideal Stirling cycle heat engine in its corresponding stages shown in FIGS. 14A, 14B and 14C. The positions shown in FIGS. 13C and 13CF represent the end of the replenishment phase and the beginning of the compression phase.

Thus on progressing beyond the positions of FIGS. 13C and 13CF the inter-mechanism flow from chamber 12*a* to chamber 12*af* terminates and the working fluid which has just been received in chamber 12*af* is allowed to flow into heat rejection means 32 wherein additional heat is extracted from the working fluid and is discarded from the system (i.e., heat is given up to the low temperature reservoir). Such a flow is depicted in FIG. 13DF and corresponds to the process occurring in FIG. 14D of the ideal Stirling cycle. It will be noted that the limited flow depicted in FIG. 13DF, which occurs during the rotary motion taking place from FIG. 13CF to FIG. 13DF, is caused by the decrease in volume being experienced in chamber 12*af*. Furthermore, during this phase, the heat rejection means 32 remains effectively blocked against passage of working fluid therethrough because the downstream port leading to chamber 12*bf* is, at this stage, closed. Accordingly, the working fluid in chamber 12*af* and in heat rejection means 32 is compressed, this compression being enhanced because of the release of heat energy from the working fluid to the heat rejection means 32. FIG. 13DF represents the end of the compression phase.

FIG. 13EF illustrates the flow taking place during the regeneration phase which starts at the end of the compression phase (FIG. 13DF) and extends until the beginning of the expansion phase (FIG. 13FF). More particularly, continued rotation from the positions of FIGS. 13D and 13DF to the positions of FIGS. 13E and 13EF causes the opening of the port leading to chamber 12*bf* and results in intra-mechanism flow of compressed working fluid from chamber 12*af* to chamber 12*bf* as illustrated in FIG. 13EF. Thus, the compressed working fluid passes into chamber 12*bf* from chamber 12*af* via heat rejection means 32, regenerator means 33*a* and heat addition means 34. It will be observed that at this phase of the cycle, chamber 12*bf* is increasing in volume while chamber 12*af* is decreasing in volume, the net result being a volumetric process closely approximating the ideal process shown in FIG. 14E. It will also be noted that during the flow between chambers 12*af* and 12bf the heat energy stored in the regenerator means 33*a* during the inter-mechanism flow of the replenishment phase (described in connection with FIGS. 13A, 12AF; 13B, 13BF; and 13C, 13CF) is released to the compressed fluid as it passes through the regenerator means. Moreover, additional heat energy is introduced into the compressed working fluid as it passes through the heat addition means 34 on its way to chamber 12*bf*. Consequently, the hot, compressed working fluid passing into expanding chamber 12*bf* possesses high internal energy suitable for conversion into useful work output. On progressing from the rotational stage of FIGS. 13E and 13EF to that shown in FIGS. 13F and 13FF, the intra-mechanism flow from chamber 12*af* to chamber 12*bf* continues until the stage shown in FIGS. 13F and 13FF is reached at which point flow out of chamber 12*af* ceases due to the closing of the port which provided egress from chamber 12*af*. This port closing marks the end of the regeneration phase.

In going from FIG. 13FF to FIG. 13GF, the expansion phase begins as hot, compressed working fluid contained in heat rejection means 32, regenerator means 33*a* and heat addition means 34 continues to flow into chamber 12*bf* while this chamber continues to increase in volume. Since the fluid involved in this continuing flow passes into chamber 12*bf* from heat addition means 34, heat energy continues to be supplied to the fluid just prior to its entry into this chamber. Hence, work output in the form of a torque transmitted to inner body 14 (and to the crankshaft 27, not shown in FIG. 13) is obtained from the expansion of this working fluid within chamber 12*bf*. Accordingly, the stage of the cycle shown in FIGS. 13F and 13FF constitutes the beginning of a positive work process—i.e., the expansion phase—within the system, a process which continues until the rotary positions of FIGS. 13G and 13GF are reached. Such a process is analogous to the work expansion phase of the ideal Stirling cycle which starts at FIG. 14F and ends at FIG. 14G.

Upon reaching the positions depicted in FIGS. 13G and 13GF, the engine has completed one complete cycle, a cycle which began in the positions shown in FIGS. 13A and 13AF. Consequently, the positions depicted in FIGS. 13G and 13GF constitute the beginning of another cycle identical to that described above. In other words, FIGS. 13G and 13GF represent the start of the replenishment phase of the succeeding cycle, a phase in which the hot, compressible working fluid contained in chamber 12*bf* of FIG. 13GF is transferred as shown through regenerator means 33*b* wherein some of its heat energy is extracted and stored for subsequent use. From the regenerator means 33*b* the fluid passes into chamber 12*b* (FIGS. 13G and 13H). It will now be readily apparent that the operations occurring on progressing from FIGS. 13G and 13GF to FIGS. 13H and 13HF correspond to those occurring on progressing from FIGS. 13A and 13AF to FIGS. 13B and 13BF, and that the entire cycle described above is continually repeated over and over again.

In summary, in the operation of a Stirling engine utilizing two rotary mechanisms of the type discussed above in which each inner body 14 has three apex portions, five cycles of the type discussed above are occurring concurrently in a non-interfering manner so as to yield continuous work output. In other words, these five cycles are progressing at different (staggered) phases at all times (note Table I) so that a positive work process from one of the cycles is always taking place.

Reference to FIG. 15 serves to facilitate an understanding of the method by which manifolding can be employed in effecting the inter-mechanism and intra-mechanism flows of working fluid which take place during the operation of the engine. It will be seen that ducts or manifolds 40*f* are secured onto plates 30*f* so as to fit over the four ports 35*f* in each such plate (only one such port being partially shown in each such plate). Similarly, closed ducts or manifolds 40*r* are secured onto plates 30*r* so as to fit over the four ports 35*r* (not shown) in each plate 30*r*. Manifolds 40*f* and 40*r* serve as individual entrance or exit passageways for each individual port 35*f* and 35*r*, respectively. In other words, all four ports 35*f* or 35*r* (as the case may be) in a given plate are isolated from each other by a manifold 40*f* or 40*r* (as the case may be). Consequently the four manifolds collectively furnish 16 passageways, each one of which leads to or from one of the 16 ports. For convenience, these passageways are individually identified in FIG. 15 by Roman numerals I through XVI, the four passageways not specifically seen in the Figure being positioned as follows:

V is on the left plate 30*r*, roughly in back of I and aligned generally with VII (offset slightly as in the case of I and III with VII being in the slightly higher position than V);

VIII is on the left plate 30*r*, roughly in back of IV and aligned generally with, but slightly offset from VI (cf. II and IV);

XIII is on the right plate 30*r*, roughly in back of IX, and aligned generally with, but slightly offset from XV (cf. IX and XI);

XVI is on the right plate 30*r*, roughly in back of XII, aligned generally with, but slightly offset from XIV (cf. X and XI).

Each of these individual passageways is connected by means of a suitable conduit or pipe or the like (not shown) either to the inlet or outlet of a regenerator means 33 (FIG. 16) or to the entrance or exit of a system (FIG. 16) composed of a heat rejection means 32, a regenerator means 33 and a heat addition means 34, a system in which means 32, 33 and 34 are arranged in series with means 33 being in between the other two.

FIG. 16 illustrates a heat transfer assembly which includes a heat rejection means 32, a regenerator means 33, a heat addition means 34 arranged in series. Working fluid that is to pass through regenerator means 33 without passing through means 32 or 34 enters at inlet 38 and leaves by way of outlet 39. Working fluid that is to pass through means 32, 33, 34 enters this system at entrance 36 and leaves this system via exit 37. Inside of regenerator means 33 are fins 45 or other suitable heat transfer bodies or members which have the ability to rapidly absorb heat or release heat (as the case may be), fins 45 or the like being arranged or constructed so as to permit fluid which enters at inlet 38 to flow through the regenerator means 33 and leave by way of outlet 39. Since heat transfer processes are involved in regenerator means 33, it will normally be suitably jacketed or insulated to prevent excessive heat losses from the system.

When forming a Stirling cycle engine of this invention using a volume displacer assembly of the type shown in FIG. 15, four heat transfer assemblies such as that shown in FIG. 16 are employed. The connections between the passageways I through XVI and these four heat transfer assemblies are shown in Table II. It will be noted that the entrance 36, exit 37, inlet 38 and outlet 39 or each of the four heat transfer assemblies are distinguished by use of the letters *a*, *b*, *c* and *d*. For example 36*a*, 37*a*, 38*a* and 39*a* represent, respectively, the entrance, exit, inlet and outlet of one such assembly. The corresponding parts of another such assembly are identified, respectively, as 36*b*, 37*b*, 38*b* and 39*b*, and so on.

TABLE II

| Connections in a Preferred Stirling Cycle Engine of this Invention | |
|---|---|
| Passageway | Heat Transfer Assembly, Part to Which Connected |
| I | Entrance 36a |
| II | Inlet 38b |
| III | Entrance 36c |
| IV | Inlet 38d |
| V | Exit 37c |
| VI | Outlet 39a |
| VII | Exit 37a |
| VIII | Outlet 39c |
| IX | Inlet 38a |
| X | Entrance 36b |
| XI | Inlet 38c |
| XII | Entrance 36d |
| XIII | Outlet 39d |
| XIV | Exit 37d |
| XV | Outlet 39b |
| XVI | Exit 37b |

In operation, an engine assembled as above will function as described above and will undergo the repetitive phase progressions concurrently taking place in five cycles in the manner set forth in Table I. This will become even more readily apparent by tracing the path thoughout the entire engine taken by a given quantity (control volume) of working fluid. Accordingly in the following tabulation the path will be traced commencing, for convenience, with the given quantity of working fluid contained in chamber 12*a* (FIG. 13A). This initially hot working fluid will do the following:

1. leave chamber 12*a*
2. pass through IX
3. go into inlet 38*a*
4. pass through regenerator means 33*a*
5. go out via outlet 39*a*
6. pass through VI
7. go into chamber 12*af*
8. leave chamber 12*af*
9. pass through I
10. go into entrance 36*a*
11. pass through heat rejection means 32*a*
12. pass through regenerator means 33*a*
13. pass through heat addition means 34*a*
14. go out via exit 37*a*
15. pass through VII
16. go into chamber 12*bf*
17. leave chamber 12*bf*
18. pass through II
19. go into inlet 38*b*
20. pass through regenerator means 33*b*
21. go out via outlet 39*b*
22. pass through XV
23. go into chamber 12*b*
24. leave chamber 12*b*

25. pass through X
26. go into entrance **36*b***
27. pass through heat rejection means **32*b***
28. pass through regenerator means **33*b***
29. pass through heat addition means **34*b***
30. go out via exit **37*b***
31. pass through XVI
32. go into chamber **12*c***
33. leave chamber **12*c***
34. pass through XI
35. go into inlet **38*c***
36. pass through regenerator means **33*c***
37. go out via outlet **39*c***
38. pass through VIII
39. go into chamber **12*cf***
40. leave chamber **12*cf***
41. pass through III
42. go into entrance **36*c***
43. pass through heat rejection means **32*c***
44. pass through regenerator means **33*c***
45. pass through heat addition means **34*c***
46. go out via exit **37*c***
47. pass through V
48. go into chamber **12*df***
49. leave chamber **12*df***
50. pass through IV
51. go into inlet **38*d***
52. pass through regenerator means **33*d***
53. go out via outlet **39*d***
54. pass through XIII
55. go into chamber **12*d***
56. leave chamber **12*d***
57. pass through XII
58. go into entrance **36*d***
59. pass through heat rejection means **32*d***
60. pass through regenerator means **33*d***
61. pass through heat addition means **34*d***
62. go out via exit **37*d***
63. pass through XIV
64. go into chamber **12*a***.

From step (64) the process repeats itself over and over again by going back to step (1) each time. It will be seen from the above tabulation that the working fluid undergoes the same sequence of operations four times—i.e., steps (1) to (16), (17) to (32), (33) to (48) and (49) to (64)—as it passes throughout the entire engine. It will also be seen that in the course of progressing through these steps the given quantity or control volume of working fluid experiences repetitively the respective state changes associated with the four phases of the Stirling cycle. The sequence involved is as follows:

| | Replenishment | Compression | Regeneration | Expansion |
|---|---|---|---|---|
| Steps: | (1) - (7) | (8) - (11) | (12) | (13) - (16) |
| | (17) - (23) | (24) - (27) | (28) | (29) - (32) |
| | (33) - (39) | (40) - (43) | (44) | (45) - (48) |
| | (49) - (55) | (56) - (59) | (60) | (61) - (64) |

Those skilled in the art will readily appreciate that the above presentation with respect to the 64 steps applies to the operation of the particular Stirling cycle engine under discussion (two rotary mechanisms each having three-apex type inner bodies). Thus, in other Stirling engines of this invention, while the same sequence of basic phases (replenishment, compression, regeneration, expansion) will be experienced, the flow passage routing for the working fluid and the number of total steps required for the control volume of working fluid to complete a circuit throughout the engine will vary depending upon the number and type of rotary mechanisms utilized.

FIG. 17 illustrates in graphical fashion an extremely advantageous feature of the Stirling engine volume displacer of the type depicted in FIG. 15. In FIG. 17 are shown four individual plots, the upper pair of which pertain to the performance characteristics of the volume displacer of FIG. 15 and the lower pair of which pertain to an ideal Stirling engine of the piston-type. In each of these curves the volume for a particular displacer chamber is plotted as a function of time (or crankshaft angle), a method of presentation described in considerable detail by Graham Walker in "Stirling-Cycle Machines," op. cit., pages 10–13. Thus, the abscissa in each case represents time, and the respective ordinates for the four plots represent the volume of the particular chambers under consideration. The uppermost pair of curves (A and B) represent the net volume changes that occur in the chambers utilized in a volume displacer of this invention during one complete cycle of operation. The replenishment phase extends from $T_1$ to $T_2$, the compression phase from $T_2$ to $T_3$, the regeneration phase from $T_3$ to $T_4$, and the expansion phase from $T_4$ to $T_5$. The lowermost pair of curves (C and D) depict the net volume changes that occur in an ideal Stirling engine of the piston-type during the same cycle of operation over the same time interval ($T_1$ to $T_5$). From the curves it can be seen that throughout the entire cycle ($T_1$ to $T_5$) the net volume changes between curves A and B closely approximate the net volume changes between curves C and D of the ideal Stirling engine. In other words, in each of the phases of operation the volume displacer of this invention functions in a manner quite similar to the idealized model of the Stirling engine, a model which apparently has not been closely approximated heretofore.

It will be evident from the foregoing that in the preferred Stirling cycle heat engines of this invention, at least two rotary mechanisms are oriented on an eccentric crankshaft 27 in a counterbalancing manner. Normally there will simply be two such rotary mechanisms working in concert with each other on a given crankshaft (note FIG. 15). In this case the inner bodies 14 of the two rotary mechanisms are mounted so as to be angularly displaced from each other by 180° relative to the eccentric crankshaft (i.e., the centroids of each respective inner body are angularly disposed 180° about a common eccentric crankshaft). Further, it is possible to devise systems having more than two such mechanisms. For example, four such rotary mechanisms may be mounted on a given crankshaft and arranged so that one pair of such mechanisms work in concert with each other in the manner described above to supply rotational torque to the crankshaft while simultaneously the other pair of such mechanisms work in concert with each other in the manner described to supply additional rotational torque to the same crankshaft whereby increased work output can be realized. Internal gearing constraint systems as described hereinabove are preferably employed in the Stirling engines of this invention and it will be understood that any suitable number of pinions 16 may be mounted on the crankshaft for rotation within their respective ring gears 18. For example, in the system depicted in FIG. 15 a pinion/ring gear combination may be mounted at or near each axial end of crankshaft 27 whereby two such combinations would be used for supplying the desired constraints to the rotational travel of the two inner bodies employed in the system. However, if desired another such combination may be mounted between the two rotary mechanisms shown in FIG. 15 so that a total of three such combinations furnish the desired constraint.

From the foregoing description it can also be seen that in the preferred Stirling cycle heat engines of this invention each axial end of the cavity 12 of the outer body 10 of each of the two (or more) rotary mechanisms employed is covered by a ported plated 30 and that, in essence, each such plate has means associated therewith providing during relative rotation between the inner bodies 14 and the outer bodies 10 of such mechanisms a preselected repetitive path of travel for compressible working fluid through the engine (note, for example, the path associated with steps (1) through (64) described above).

Since high pressures are maintained within a Stirling cycle power plant, sealing is an important design consideration. An advantageous feature of the Stirling cycle heat engines of this invention is that each rotary mechanism is completely self-contained with only a purely rotating shaft 27 emerging from its housing. Thus, each such rotary mechanism can be sealed hermetically in a permanent manner by use of presently-available sealing materials and methods. The internal seals involving the apex portions 15 and median portions 17 involve sealing considerations and techniques similar to those involved in previously known rotary engine systems. Since internal combustion does not occur within the Stirling engines of this invention, fuel deposits do not form on the inner surfaces upon which the seals must be maintained. Therefore with a contaminant-free environment, seal maintenance is not materially impaired by the presence or buildup of deleterious foreign material. Also, with lubricant contained directly in the working fluid medium—a technique which may be employed pursuant to this invention, if desired—lubrication may be provided continuously and thereby reduce the amount of servicing and maintenance required.

FIG. 18 illustrates the use of contoured sealing plates on the inner body 14. As shown, at each apex portion a sealing plate 42 is provided which fits into a suitable recess or groove in the outer surface of the inner body and is suitably affixed or fastened in place. Likewise, a sealing plate 43 of appropriate configuration fits into a suitable recess so as to furnish a sealing surface at each median portion. It will be seen from FIG. 18 that the profile of the inner body 14 will not be materially changed by the use of sealing plates 42 and 43. Their functions are primarily to enable the use of specially developed metallic alloys or the like for effecting the sealing engagement with profile 20 so that better and longer lasting sealing may be achieved and to enable periodic replacement of these surfaces should this become necessary or desirable. It is feasible to place the sealing plates 42 and 43 under lateral tension by designing them slightly larger in profile than the recess in which they are to be received. In this way the sealing plates will tend to bow and flex to a slight extent and thereby assist in maintaining the seal without incurring excessive wear or friction. It will of course be apparent that any suitable metals, composite materials or engineering plastics may be used in making these sealing plates and, in fact, a number of materials are already well established in uses similar to the sealing application here involved. Whether or not such sealing plates are employed, it is preferable that the outer profile of inner body 14 be regular and uniform in configuration so that the inner body is balanced about its axis. In this way excessive seal wear, vibration and leakage during operation are minimized.

It will thus be apparent that this invention provides a rotary mechanism which can be used in conjunction with external combustion to produce power at high efficiency, at a low pollution level, with low grade fuel. Additionally, the external heat energy supplied to the Stirling cycle engines of this invention is not limited to combustion processes. The heat energy supplied to the system via the heat addition means 34 can be derived from various sources such as nuclear processes, solar energy, electrical energy, and the like.

It should be understood that the present disclosure is for the purpose of illustration and that this invention includes all modifications and equivalents which fall within the scope of the appended claims.

I claim:

1. A rotary mechanism for pumps, fluid motors, heat engines or the like; said mechanism comprising an outer body having a cavity and an inner body received within said outer body cavity for relative rotation therein with the axis of the inner body being laterally spaced from but parallel to the axis of the outer body cavity, said inner body having an outer surface basically composed in cross-section of (i) a plurality of apex portions equally spaced about and equidistant from the axis of the inner body, (ii) a plurality of median portions equally spaced about and equidistant from the axis of the inner body, each median portion being positioned between and spaced apart from two said apex portions, and (iii) a plurality of connecting portions, each said median portion being joined to each of its adjacent apex portions by a connecting portion, each said apex portion being in continuous sealing engagement with the inner surface of the peripheral wall of said outer body cavity during relative rotation of said bodies about said axes, each said median portion periodically being in sealing engagement with and periodically being disengaged from the inner surface of the peripheral wall of said outer body cavity during relative rotation of said bodies about said axes, there being no sealing engagement between said connecting portions and the inner surface of the peripheral wall of said outer body cavity during relative rotation of said bodies about said axes, said mechanism being further characterized in that said outer body has in cross section a multiple-sided profile in which there is one more side to the cavity than the number of apex portions on said inner body and in that during said relative rotation each one of said median portions undergoes periodical sealing engagement with each successive side of said multiple-sided profile.

2. A rotary mechanism as recited in claim 1 in which said inner body has from three to six apex portions.

3. A rotary mechanism in accordance with claim 1 in which said bodies are adapted to undergo relative rotation with internal gearing constraints.

4. A rotary mechanism in accordance with claim 1 wherein said outer body is static with respect to said inner body, and said inner body is adapted to undergo the rotary motion.

5. A rotary mechanism for pumps, fluid motors, heat engines or the like; said mechanism comprising an outer body having a cavity and an inner body received within said outer body cavity for relative rotation therein with the axis of the inner body being laterally spaced from but parallel to the axis of the outer body cavity, said inner body having an outer surface basically composed in cross-section of (i) a plurality of apex portions each having essentially the same contour, said apex portions being equally spaced about and equidistant from the axis of the inner body, (ii) a plurality of median portions each having essentially the same contour, said median portions being equally spaced about and equidistant from the axis of the inner body, each median portion being positioned equidistantly between and spaced apart from two said apex portions, and (iii) a plurality of connecting portions, each said median portion being joined to each of its adjacent apex portions by a connecting portion, each said apex portion being in continuous sealing engagement with the inner surface of the peripheral wall of said outer body cavity during relative rotation of said bodies about said axes, each said median portion periodically being in sealing engagement with and periodically being disengaged from the inner surface of the peripheral wall of said outer body cavity during relative rotation of said bodies about said axes, there being no sealing engagement between said connecting portions and the inner surface of the peripheral wall of said outer body cavity during relative rotation of said bodies about said axes, said mechanism being further characterized in that said outer body has in cross section a multiple-sided profile in which there is one more side to the cavity than the number of apex portions on said inner body and in that during said relative rotation each one of said median portions undergoes periodical sealing engagement with each successive side of said multiple-sided profile.

6. A rotary mechanism as recited in claim 5 in which said inner body has two apex portions and said outer body cavity takes on generally a three-sided profile.

7. A rotary mechanism as recited in claim 5 in which said inner body has three apex portions and said outer body cavity takes on generally a four-sided profile.

8. A rotary mechanism as recited in claim 5 in which each said apex portion is composed of a contoured sealing plate having progressive portions of its outer face in sealing engagement with the inner surface of the peripheral wall of said outer body cavity during relative rotation of said bodies about said axes.

9. A rotary mechanism as recited in claim 5 in which each said median portion is composed of a contoured sealing plate periodically having progressive portions of its outer face in sealing engagement with the inner surface of the peripheral wall of said outer body cavity during relative rotation of said bodies about said axes.

10. A rotary mechanism in accordance with claim 5 in which said bodies are adapted to undergo relative rotation with internal gearing constraints.

11. A rotary mechanism as recited in claim 5 wherein each axial end of the cavity of the outer body is covered by a plate having therein a plurality of port openings radially spaced about the axis of said cavity and wherein said inner body has at its axial ends a plurality of channels each of which is positioned so that periodically upon relative rotation of said bodies about said axes open communication is provided between (i) a chamber defined by the outer surface of said inner body and the inner surface of the peripheral wall of said outer body cavity, and (ii) one of said port openings (iii) by way of one of said channels.

12. A rotary mechanism as recited in claim 11 wherein the number of port openings in each said plate is one greater than the number of apex portions of said inner body and wherein the number of channels at each axial end of the inner body is equal to the number of apex portions of said inner body.

13. A rotary mechanism as recited in claim 11 in which (i) said inner body has three apex portions and takes on a generally three-sided profile, (ii) said outer body cavity takes on a generally four-sided profile, (iii) each said plate has four port openings therein essentially equally spaced about and essentially equidistant from the axis of said cavity, and (iv) each axial end of said inner body has three said channels each one of which extends inwardly from one of the respective sides of the inner body.

14. A rotary mechanism as recited in claim 13 wherein said inner body has six separate channels and six connecting portions, three of said channels being located at each axial end of said inner body, each one of the respective six connecting portions having one said channel extending inwardly therefrom.

15. A rotary mechanism as recited in claim 14 wherein the mouth of each successive channel around the periphery of the inner body is alternately positioned so that the first, third, and fifth channels are at one axial end of said inner body and the second, fourth and sixth channels are at the other axial end of said inner body.

16. A rotary mechanism as recited in claim 5 wherein each axial end of the cavity of the outer body is covered by a plate having therein a plurality of port openings radially spaced about the axis of said cavity; wherein said inner body has at its axial ends a plurality of channels each of which is positioned so that periodically upon relative rotation of said bodies about said axes open communication is provided between (i) a chamber defined by the outer surface of said inner body and the inner surface of the peripheral wall of said outer body cavity, and (ii) one of said port openings (iii) by way of one of said channels; and wherein said bodies are adapted to undergo relative rotation with internal gearing constraints.

17. A rotary mechanism as recited in claim 5 wherein the distance of the lateral spacing between the axis of the inner body and the axis of the outer body cavity is substantially equivalent to the expression $(1)/n\ (D - R)$ where $n$ is the number of apex portions on said inner body, $D$ is the distance between the radially outermost point on the inner body and the axis of said inner body, and $R$ is the average radius of curvature of the profiles of said apex portions.

18. A rotary mechanism as recited in claim 5 wherein the length of the profile of each said apex portion is equivalent to from about 0.25 to about 2.75 radians.

19. A rotary mechanism for pumps, fluid motors, heat engines or the like; said mechanism comprising an outer body having a cavity and an inner body received within said outer body cavity for relative rotation therein with the axis of the inner body being laterally spaced from but parallel to the axis of the outer body cavity, said inner body having an outer surface basically composed in cross-section of (i) a plurality of apex portions each having essentially the same contour, said apex portions being equally spaced about and equidistant from the axis of the inner body, (ii) a plurality of median portions each having essentially the same contour, said median portions being equally spaced about and equidistant from the axis of the inner body, each median portion being positioned equidistantly between and spaced apart from two said apex portions, and (iii) a plurality of connecting portions, each said median portion being joined to each of its adjacent apex portions by a connecting portion, the inner surface of the peripheral wall of said outer body cavity having essentially the profile defined by the radially outermost points in the family of hypotrochoidal curves traced by the series of points describing an apex portion of the inner body, the tracing occurring as said inner body is rotated in a trochoidal manner with the base reference being the axis of the outer body, the outer surface of said inner body with the exception of said connecting portions having essentially the profile defined by the radially innermost points in the family of epitrochoidal curves traced by the series of points describing the inner surface of the peripheral wall of said outer body cavity, the tracing occurring as said outer body is rotated in a trochoidal manner with the base reference being the axis of the inner body, each of said apex portion being in continuous sealing engagement with the inner surface of the peripheral wall of said outer body cavity during relative rotation of said bodies about said axes, each said median portion periodically being in sealing engagement with and periodically being disengaged from the inner surface of the peripheral wall of said outer body cavity during relative rotation of said bodies about said axes.

20. A rotary mechanism as recited in claim 19 in which said inner body has two apex portions and said outer body cavity takes on generally a three-sided profile.

21. A rotary mechanism as recited in claim 19 in which said inner body has three apex portions and said outer body cavity takes on generally a four-sided profile.

22. A rotary mechanism as recited in claim 19 in which each said apex portion is composed of a contoured sealing plate having progressive portions of its outer face in sealing engagement with the inner surface of the peripheral wall of said outer body cavity during relative rotation of said bodies about said axes.

23. A rotary mechanism as recited in claim 19 in which each said median portion is composed of a contoured sealing plate periodically having progressive portions of its outer face in sealing engagement with the inner surface of the peripheral wall of said outer body cavity during relative rotation of said bodies about said axes.

24. A rotary mechanism as recited in claim 19 in which each said connecting portion is described by a profile corresponding to or radially recessed from the profile created by said innermost points.

25. A rotary mechanism as recited in claim 19 in which the profile of said outer body cavity is slightly enlarged from said radially outermost points in a uniform manner.

26. A rotary mechanism in accordance with claim 19 in which said bodies are adapted to undergo relative rotation with internal gearing constraints.

27. A rotary mechanism as recited in claim 19 wherein each axial end of the cavity of the outer body is covered by a plate having therein a plurality of port openings radially spaced about the axis of said cavity and wherein said inner body has at its axial ends a plurality of channels each of which is positioned to that periodically upon relative rotation of said bodies about said axes open communication is provided between (i) a chamber defined by the outer surface of said inner body and the inner surface of the peripheral wall of said outer body cavity, and (ii) one of said port openings (iii) by way of one of said channels.

28. A rotary mechanism as recited in claim 27 wherein the number of port openings in each said plate is one greater than the number of apex portions of said inner body and wherein the number of channels at each axial end of the inner body is equal to the number of apex portions of said inner body.

29. A rotary mechanism as recited in claim 27 in which (i) said inner body has three apex portions and takes on a generally three-sided profile, (ii) said outer body cavity takes on a generally four-sided profile, (iii) each said plate has four port openings therein essentially equally spaced about and essentially equidistant from the axis of said cavity, and (iv) each axial end of said inner body has three said channels each one of which extends inwardly from one of the respective sides of the inner body.

30. A rotary mechanism as recited in claim 29 wherein said inner body has six separate channels and six connecting portions, three of said channels being located at each axial end of said inner body, each one of the respective six connecting portions having one said channel extending inwardly therefrom.

31. A rotary mechanism as recited in claim 30 wherein the mouth of each successive channel around the periphery of the inner body is alternately positioned so that the first, third and fifth channels are at one axial end of said inner body and the second, fourth and sixth channels are at the other axial end of said inner body.

32. A rotary mechanism as recited in claim 19 wherein each axial end of the cavity of the outer body is covered by a plate having therein a plurality of port openings radially spaced about the axis of said cavity; wherein said inner body has at its axial ends a plurality of channels each of which is positioned so that periodically upon relative rotation of said bodies about said axes open communication if provided between (i) a chamber defined by the outer surface of said inner body and the inner surface of the peripheral wall of said outer body cavity, and (ii) one of said port openings (iii) by way of one of said channels; and wherein said bodies are adapted to undergo relative rotation with internal gearing constraints.

33. A rotary mechanism as recited in claim 32 in which (i) said inner body has three apex portions and takes on a generally three-sided profile, (ii) said outer body cavity takes on a generally four-sided profile, (iii) each said plate has four port openings therein essentially equally spaced about and essentially equidistant from the axis of said cavity, and (iv) each axial end of said inner body has three said channels each one of which extends inwardly from one of the respective sides of the inner body.

34. A rotary mechanism as recited in claim 19 wherein the distance of the lateral spacing between the axis of the inner body and the axis of the outer body cavity is substantially equivalent to the expression $$(1)/n\ (D - R)$$

where $n$ is the number of apex portions on said inner body, $D$ is the distance between the radially outermost point on the inner body and the axis of said inner body, and $R$ is the average radius of curvature of the profiles of said apex portions.

35. A rotary mechanism as recited in claim 19 wherein the length of the profile of each said apex portion is equivalent to from about 0.25 to about 2.75 radians.

36. In a Stirling cycle heat engine comprising a mechanism for varying in a cyclical manner the volumes of a plurality of chambers associated therewith, heat rejection means, regenerator means, and heat addition means, the improvement according to which the mechanism for varying the volumes of said chambers is a rotary mechanism comprising an outer body having a cavity and an inner body received within said outer body cavity for relative rotation therein with the axis of the inner body being laterally spaced from but parallel to the axis of the outer body cavity, said inner body having an outer surface basically composed in cross-section of (i) a plurality of apex portions equally spaced about and equidistant from the axis of the inner body, (ii) a plurality of median portions equally spaced about and equidistant from the axis of the inner body, each median portion being positioned between and spaced apart from two said apex portions, and (iii) a plurality of connecting portions, each said median portion being joined to each of its adjacent apex portions by a connecting portion, each said apex portion being in continuous sealing engagement with the inner surface of the peripheral wall of said outer body cavity during relative rotation of said bodies about said axes, each said median portion periodically being in sealing engagement with and periodically being disengaged from the inner surface of the peripheral wall of said outer body cavity during relative rotation of said bodies about said axes, there being no sealing engagement between said connecting portions and the inner surface of the peripheral wall of said outer body cavity during relative rotation of said bodies about said axes, said mechanism being further characterized in that said outer body has in cross section a multiple-sided profile in which there is one more side to the cavity than the number of apex portions on said inner body and in that during said relative rotation each one of said median portions undergoes periodical sealing engagement with each successive side of said multiple-sided profile.

37. A Stirling cycle heat engine in accordance with claim 36 wherein at least two said rotary mechanisms are oriented on an eccentric crankshaft in a counterbalancing manner.

38. A Stirling cycle heat engine in accordance with claim 37 further characterized in that the inner body of each said rotary mechanism has three apex portions and the outer body cavity of each said rotary mechanism takes on a generally a four-sided profile.

39. A Stirling cycle heat engine in accordance with claim 37 further characterized in that said inner and outer bodies are adapted to undergo relative rotation with internal gearing constraints.

40. A Stirling cycle heat engine in accordance with claim 37 further characterized in that each axial end of the cavity of the outer body of each said rotary mechanism is covered by a plate having therein a plurality of port openings radially spaced about the axis of said cavity and wherein the inner body of each said rotary mechanism has at its axial ends a plurality of channels each of which is positioned so that periodically upon relative rotation of said inner and outer bodies about said axes open communication is provided between (i) a chamber defined by the outer surface of said inner body and the inner surface of the peripheral wall of said outer body cavity, and (ii) one of said port openings (iii) by way of one of said channels.

41. A Stirling cycle heat engine in accordance with claim 37 further characterized in that (i) the inner body of each of said rotary mechanism has three apex portions and the outer body cavity of each said rotary mechanism takes on a generally a four-sided profile, (ii) said inner and outer bodies are adapted to undergo relative rotation with internal gearing constraints, (iii) each axial end of the cavity of the outer body of each said rotary mechanism is covered by a plate having therein a plurality of port openings radially spaced about the axis of said cavity and wherein the inner body of each said rotary mechanism has at its axial ends a plurality of channels each of which is positioned so that periodically upon relative rotation of said inner and outer bodies about said axes open communication is provided between (a) a chamber defined by the outer surface of said inner body and the inner surface of the peripheral wall of said outer body cavity, (b) one of said port openings (c) by way of one of said channels, and (iv) said inner body is adapted to undergo the rotary motion.

42. A Stirling cycle heat engine in accordance with claim 36 wherein at least two said rotary mechanisms are oriented on an eccentric crankshaft in a counterbalancing manner and wherein each axial end of the cavity of the outer body of each said rotary mechanism is covered by a ported plate having means associated therewith providing during relative rotation between the inner bodies and the outer bodies of said mechanisms a preselected repetitive path of travel for compressible working fluid through said engine.

43. A Stirling cycle heat engine in accordance with claim 36 wherein at least two said rotary mechanisms are oriented on an eccentric crankshaft in a counterbalancing manner; wherein said inner bodies and said crankshaft are adapted to undergo the rotary motion in unison, the outer bodies of said rotary mechanisms being static with respect to said inner bodies; wherein the outer profile of the inner body of each said rotary mechanism is regular and uniform so that the inner body is balanced about its axis; wherein the inner body of each said rotary mechanism has three apex portions and the outer body cavity of each said rotary mechanism takes on generally a four-sided profile; and wherein each axial end of the cavity of the outer body of each said rotary mechanism is covered by a ported plate having means associated therewith providing during said rotary motion a pre-selected repetitive path of travel for compressible working fluid through said engine.

* * * * *